US009180343B2

(12) United States Patent
Yeo

(10) Patent No.: US 9,180,343 B2
(45) Date of Patent: Nov. 10, 2015

(54) JOINT COMMONALITY SUBMERSIBLE (JCS)

(75) Inventor: Chee Hui Yeo, Singapore (SG)

(73) Assignee: OPCON PTE LTD, Singapore (SG)

( * ) Notice: Subject to any disclaimer, the term of this patent is extended or adjusted under 35 U.S.C. 154(b) by 0 days.

(21) Appl. No.: 13/579,320

(22) PCT Filed: Mar. 22, 2011

(86) PCT No.: PCT/SG2011/000110
§ 371 (c)(1),
(2), (4) Date: Aug. 16, 2012

(87) PCT Pub. No.: WO2011/119110
PCT Pub. Date: Sep. 29, 2011

(65) Prior Publication Data

US 2012/0309241 A1 Dec. 6, 2012

(30) Foreign Application Priority Data

Mar. 22, 2010 (SG) ..... 201001995-8

(51) Int. Cl.
*B63C 11/46* (2006.01)
*A63B 35/12* (2006.01)

(52) U.S. Cl.
CPC ..... *A63B 35/12* (2013.01); *B63C 11/46* (2013.01)

(58) Field of Classification Search
CPC ..... A63B 35/12; A63B 31/11; B63C 11/42; B63B 35/731
USPC ..... 440/1, 38; 114/315; 701/21; 362/477; 403/322.4, 325, 326, 327
See application file for complete search history.

(56) References Cited

U.S. PATENT DOCUMENTS

| | | | | |
|---|---|---|---|---|
| 3,635,188 | A | 1/1972 | Rutkowski | |
| 3,957,183 | A * | 5/1976 | Gadberry | 224/628 |
| 4,700,654 | A | 10/1987 | Borges | |
| 4,795,359 | A * | 1/1989 | Alcock et al. | 439/271 |
| 4,985,812 | A | 1/1991 | Uke | |
| 4,996,938 | A | 3/1991 | Cameron et al. | |
| 5,009,222 | A | 4/1991 | Her | |
| 5,365,868 | A * | 11/1994 | Culotta | 114/315 |

(Continued)

FOREIGN PATENT DOCUMENTS

| | | |
|---|---|---|
| CH | 666662 A5 | 8/1988 |
| FR | 2608441 A1 | 6/1988 |

(Continued)

OTHER PUBLICATIONS

Foreign Communication from a Related Counterpart Application—International Search Report and Written Opinion, PCT/SG2011/000110, Jun. 9, 2011.

(Continued)

*Primary Examiner* — S. Joseph Morano
*Assistant Examiner* — Andrew Polay

(57) ABSTRACT

An underwater propulsion device includes a number of modules allowing it to be used in a range of configurations including a tow/pull type scooter 300, a thigh strap configuration 700, a calf strap configuration 1100, a push configuration 1200, a tank mount configuration 1300. The device may include an underwater changeable battery canister 1600, a hand controller 216 that senses movement about the radius bone to generate direction and speed control signals and/or a front mounted headlight 224.

20 Claims, 23 Drawing Sheets

(56) References Cited

U.S. PATENT DOCUMENTS

| | | | | |
|---|---|---|---|---|
| 5,469,803 | A | 11/1995 | Gallo | |
| 5,509,372 | A * | 4/1996 | Culotta | 114/315 |
| 6,341,993 | B1 | 1/2002 | Lalli, Jr. | |
| 6,461,204 | B1 | 10/2002 | Takura et al. | |
| 6,823,813 | B2 | 11/2004 | Mazin | |
| 7,270,074 | B2 | 9/2007 | Pradetto et al. | |
| 7,393,117 | B2 * | 7/2008 | Dalton et al. | 362/157 |
| 7,891,903 | B2 * | 2/2011 | Klingenberg et al. | 403/322.2 |
| 8,033,234 | B2 * | 10/2011 | Vitale | 114/315 |
| 8,290,636 | B2 * | 10/2012 | Manning | 701/1 |
| 2002/0024500 | A1 | 2/2002 | Howard | |
| 2002/0119712 | A1 | 8/2002 | Grimmeisen | |
| 2006/0094310 | A1 | 5/2006 | Railey | |
| 2006/0243188 | A1 | 11/2006 | Pradetto et al. | |
| 2008/0254689 | A1 * | 10/2008 | Kaji | 440/1 |
| 2011/0056423 | A1 * | 3/2011 | Railey | 114/55.56 |

FOREIGN PATENT DOCUMENTS

| | | | |
|---|---|---|---|
| FR | 2763512 | A1 | 5/1998 |
| GB | 2322469 | A | 8/1998 |
| GB | 2359049 | A | 8/2001 |
| JP | 7187071 | A | 7/1995 |
| JP | 2004319355 | A | 11/2004 |
| JP | 2009218012 | A | 9/2009 |
| WO | 8300128 | A1 | 1/1983 |
| WO | 8602613 | A1 | 5/1986 |
| WO | 02072382 | A1 | 9/2002 |
| WO | 02102658 | A1 | 12/2002 |
| WO | 2004050473 | A1 | 6/2004 |
| WO | 2004062744 | A1 | 7/2004 |
| WO | 2005080194 | A1 | 9/2005 |

OTHER PUBLICATIONS

Foreign Communication from a Related Counterpart Application—International Preliminary Report on Patentability, PCT/SG2011/000110, Nov. 8, 2011.

Search and Advisory Service Search Report, Patent Search: Scuba diving equipment, SG1626, Oct. 20, 2010, Intellectual Property Office, UK.

"SEABOB", http://www.seabob.com/en/index.html, (last visited Aug. 16, 2012), Cayago AG.

"Undersea War Fighter—CCR Module—DEMA 2010", http://vimeo.com/17092755, (last visited Aug. 16, 2012), Vimeo, LLC.

"Patriot 3 Maritime Jet Boots—DEMA 2010", http://vimeo.com/17094858, last visited Aug. 16, 2012), Vimeo, LLC.

* cited by examiner 200
200
200

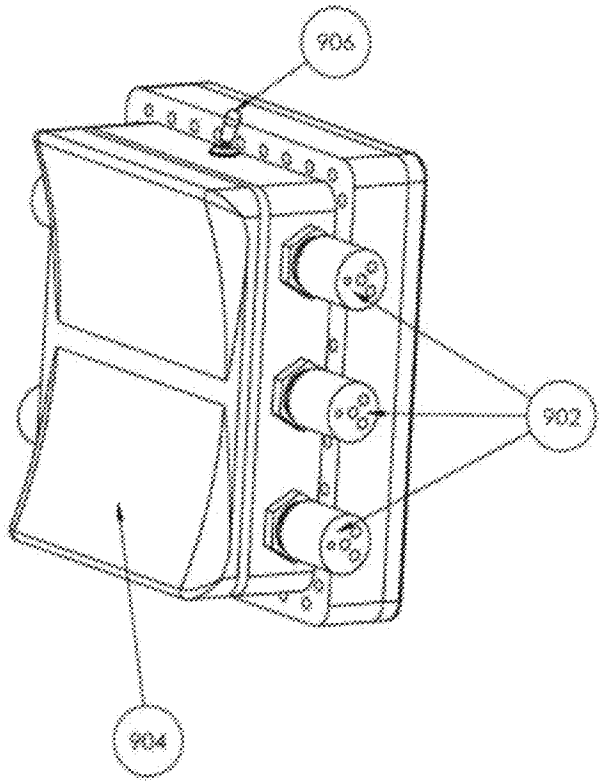
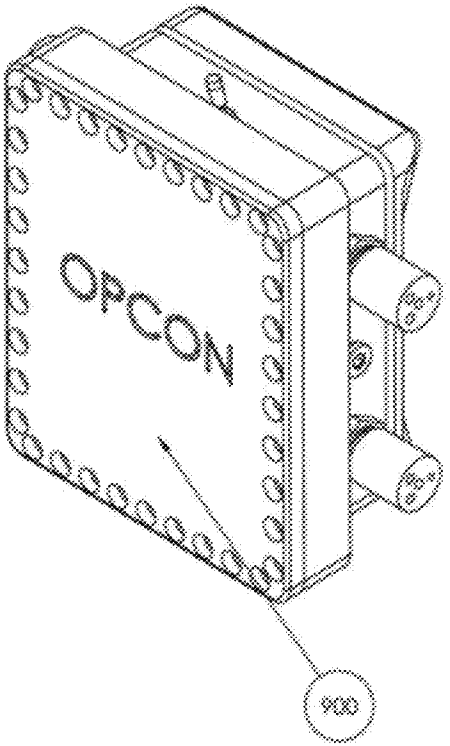
FIGURE 9

1600
1604
1602
1608
1606
1610
1612
1614
1616
1618
1620
1622
1624
1626
1628
1630
1632
1634
1636
1638
1640
1642
1644
1646
1648
1650
1652
1654
1656
1658
1660
1662
1664
1666
1668
1670
1672
1674
1676
1678
1680
1682
1684
1686
1688

JOINT COMMONALITY SUBMERSIBLE (JCS)

CROSS-REFERENCE TO RELATED APPLICATIONS

This application is a filing under 35 U.S.C. 371 and National Stage of International Application No. PCT/SG2011/000110, filed Mar. 22, 2011 and entitled "A Joint Community Submersible (JCS)," which claims priority to SG 201001995-8, filed Mar. 22, 2010 and entitled "A Joint Community Submersible (JCS)," both of which are incorporated herein by reference in their entirety for all purposes.

FIELD

The present invention relates to a Joint Commonality Submersible (JCS) particularly though not solely to an underwater propulsion device for attachment to a scuba diver.

BACKGROUND

U.S. Pat. No. 6,823,813 ("Mazin") discloses a leg mounted propulsion device for swimmers and divers. Propulsion units are attached to the diver's legs. A battery pack is either attached as a weight belt or as a cylinder beside the air tank. A controller is attached to the belt beside the buckle on the stomach of the diver.

Mazin may suffer from a number of disadvantages including lack of adequate sealing for the battery pack, lack of modularity, difficulty of access to the controller (especially when the diver's hands are already holding other equipment), lack of flexibility in control, and/or lack of user friendliness and difficulty of user servicing.

There is also a range of other propulsion devices known in the art. For example tow type designs disclosed in U.S. Pat. Nos. 4,996,938 and 5,469,803; different kinds of body strap designs disclosed in International patent publication numbers 02072382 and 2004062744, French patent numbers 2608441 and 2763512, and U.S. Pat. Nos. 3,635,188 and 4,700,654; push type designs strapped between the knees; and tank mounted designs disclosed in International patent publication numbers 8602613, 2004050473 and 2005080194, U.S. Pat. No. 5,365,868, US patent publication number 2006243188 and Australian patent number 8070794.

It would be desirable to provide a submersible or underwater propulsion device which overcomes one or more of these disadvantages and/or which at least provides the public with a useful choice.

SUMMARY

In general terms the invention proposes a propulsion device with:

- motion-sensing capabilities, from the user wrist or any parts of the body that can attach motion sensor(s);
- modularity, so that the user can easily select between a plurality of user attachment configurations;
- quick-release connectors for the thrusters;
- underwater reconfigurability;
- modularity, for variable methods of propulsion; and/or
- effective battery sealing and/or underwater battery replacement.

Such a propulsion device may have the advantage that sealing of the battery pack may be improved even if the outer casing is opened while the diver is still wet; additional modules may be easily added; a much wider range of control options and user interactivity may be possible; user friendliness may be improved; users may easily service or upgrade the device anywhere; the device may be attached via a tow/pull type scooter, via a thigh strap, via a calf strap, between the thighs as a push-type, or to the tank or a rebreather unit; more intuitive and/or reduced fatigue control effort; a user can pre-fix the mounting before fixing the thrusters on in the water; a user can remove the thrusters in an emergency; a user can change the system from one form to another underwater without surfacing (e.g. diver using a conventional underwater scooter form, needs to go through a small port hole of a ship wreck, can dismantle the scooter into small parts, push through the port hole and calve mount it); propulsion can be via propeller, jet or pump; and/or the user may be able to change batteries underwater to extend travel distance without surfacing.

In a first particular expression of the invention there is provided an underwater propulsion device as claimed in claim 1.

Example implementations of the invention are provided in any one of claims 2 to 13 and 16.

In a second particular expression of the invention there is provided a controller as claimed in claim 14.

In a second particular expression of the invention there is provided a headlight module as claimed in claim 15.

BRIEF DESCRIPTION OF DRAWINGS

One or more example embodiments of the invention will now be described, with reference to the following figures, in which:

FIG. 9 is a perspective view of the ECM module configuration in FIG. 7;

DETAILED DESCRIPTION

Figure 1:
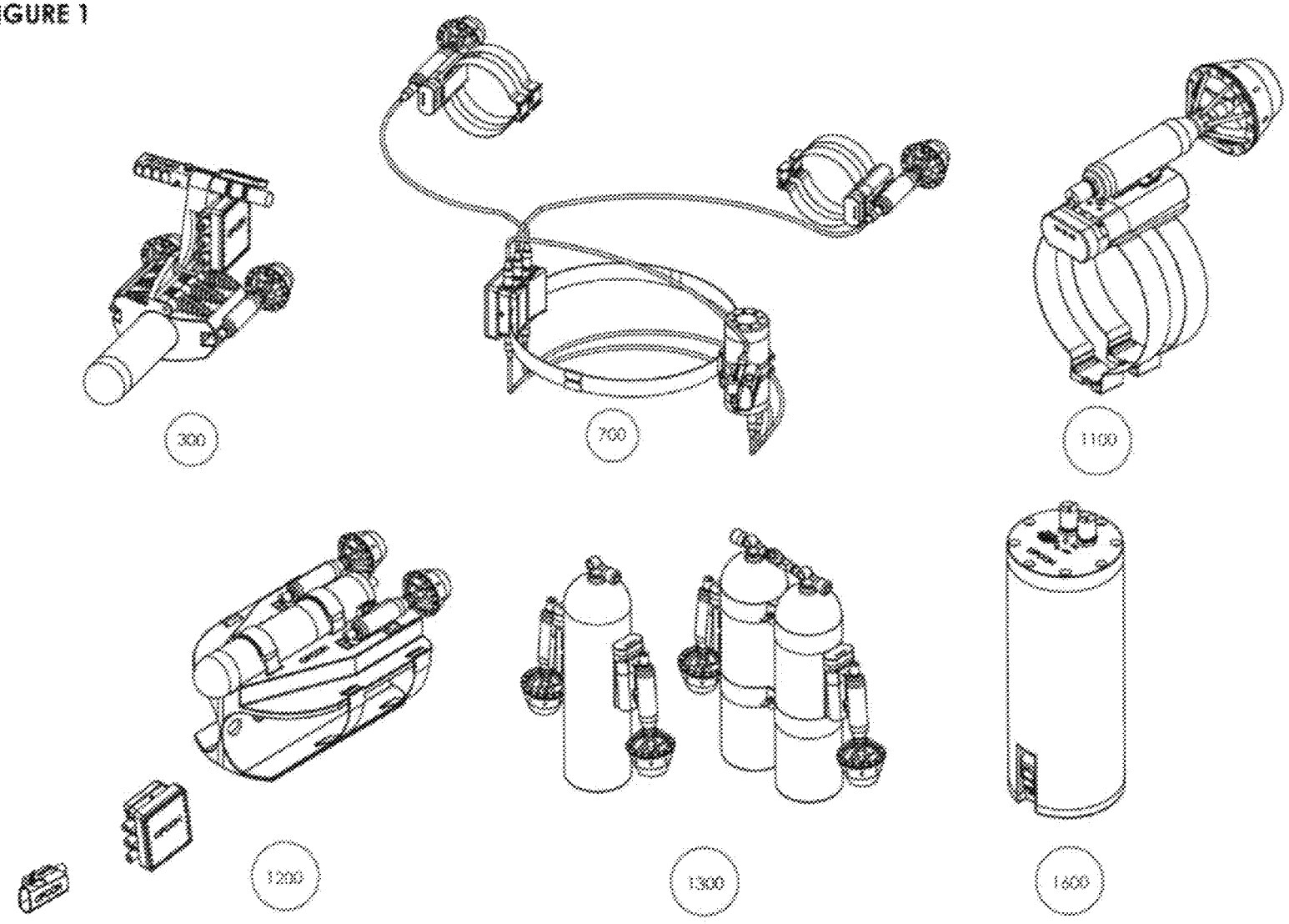
FIG. 1 is a schematic view of various embodiments of a propulsion device according to an example embodiment.

FIG. 1 shows a range of different embodiments for an underwater propulsion device. In a first embodiment the device is configured as a tow/pull type scooter 300. In a second embodiment the device is attached to the user with a thigh strap configuration 700. In a third embodiment the device is attached to the user with a calf strap configuration 1100. In a fourth embodiment the device is attached between the thighs of the user in a push configuration 1200. In a fifth embodiment the device is an attached tank mount configuration 1300. In a sixth embodiment the device includes an underwater changeable battery canister 1600.

Figure 2:
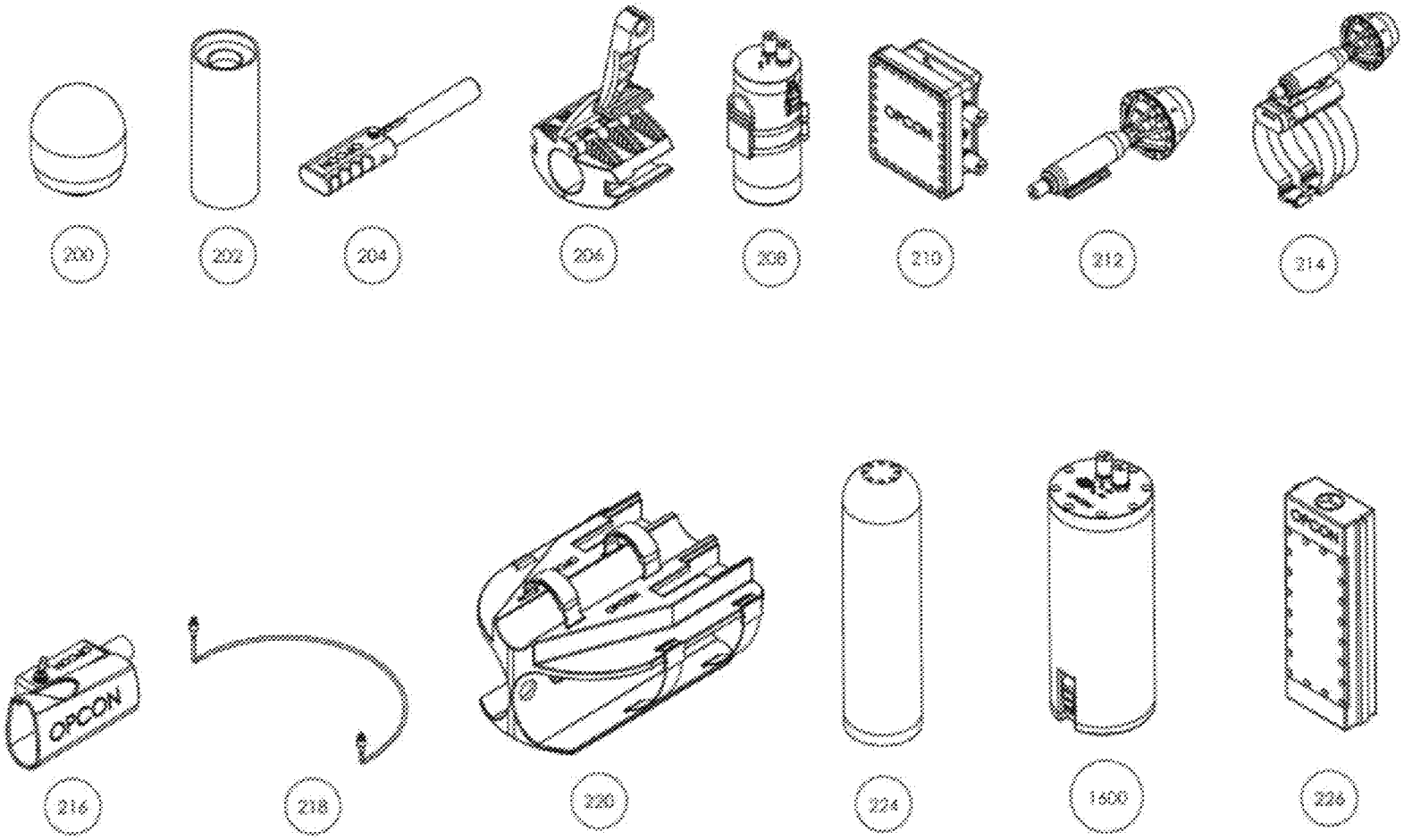
FIG. 2 is a schematic view of the parts used in the embodiments in FIG. 1.
Figure 3:
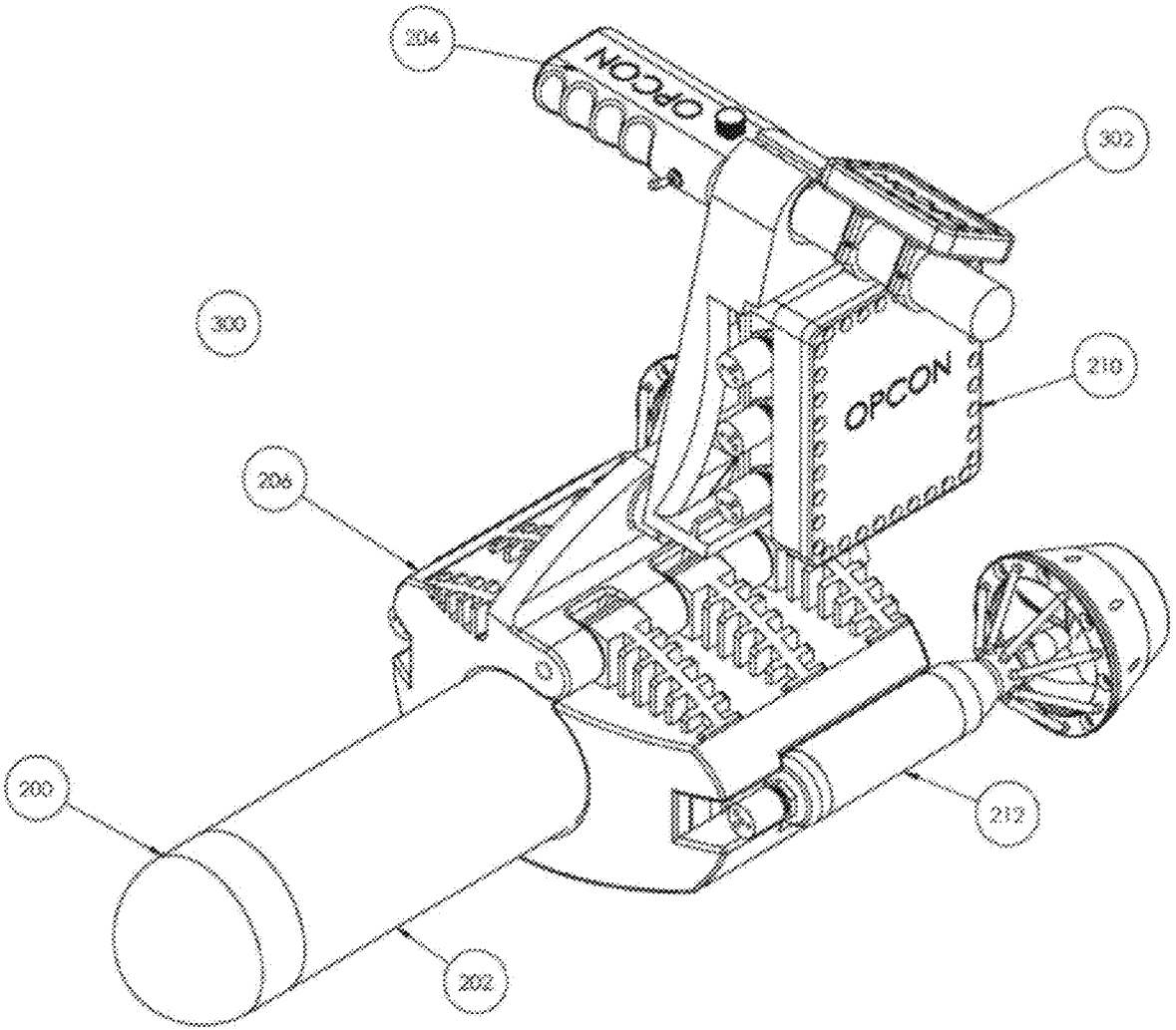
FIG. 3 is a perspective view of the tow/pull type scooter in FIG. 1.
Figure 4:
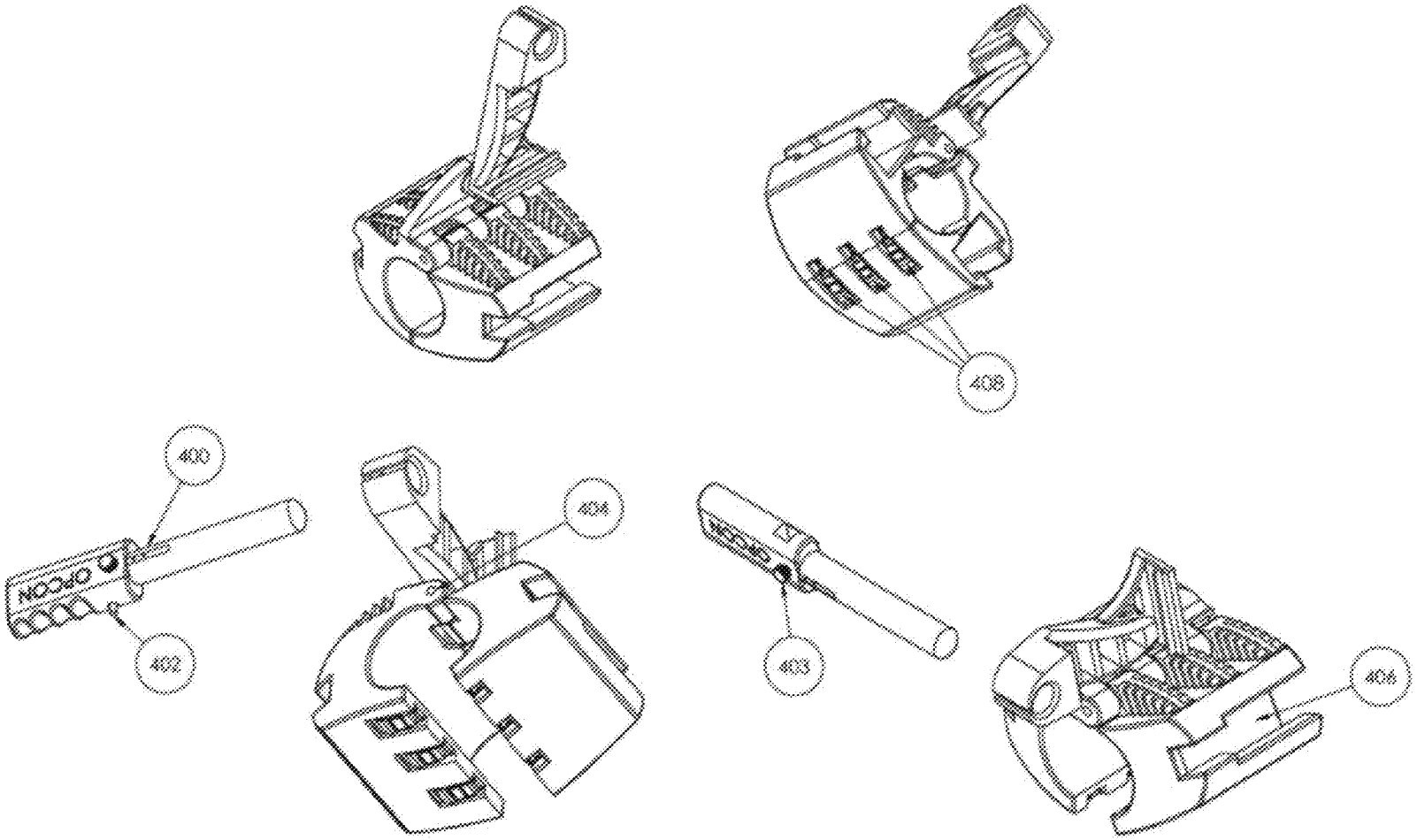
FIG. 4 is an exploded view of the tow/pull type scooter in FIG. 3.

All of the embodiments can be configured using a complete set of parts shown in FIG. 2. The parts include a canister head 200, a body adapter 202, a hand bar 204, a tow converter 206, a battery canister 208, an ECM module or driver casing 210, a thruster 212 with quick release adapter 214, a hand controller 216, cables 218, push converter 220, a headlight canister 224, the underwater changeable battery canister 1600 and a waterproof battery pack 226.

If the user has the complete set of parts shown in FIG. 2, they have the ability to easily configure the device into any of the embodiments mentioned above. This can either occur prior to a dive, or in some cases, the user can reconfigure the device underwater. For example, if the diver is using the thigh strap configuration 700, and becomes entangled underwater e.g. fishing net, the diver can dismantle the thigh strap configuration 700 into parts, get out of the net and reattach to whichever configuration suitable for safe travelling afterwards. This design also allows more situation control by the diver.

Tow/Pull Type Scooter

The tow/pull type scooter 300 according to the first embodiment is shown in FIGS. 3 to 6. In the first embodiment the diver holds onto the hand bar 204 and is towed by the tow/pull type scooter 300. The hand bar 204 is mounted using locking mechanism 400 to the tow converter 206. An on/off switch 402 and/or speed control knob 403 (on/off switch can also be incorporated into the speed control knob) is provided on the hand bar 204, which is connected via the cables 218 to the ECM module 210. On either side slots 406 are provided to house each quick release adapter 214, to which in turn each thruster 212 is attached to. The ECM module 210 slots into the side of the tow converter 206. An LCD panel 302 may also be provided on the hand bar 204.

The tow converter 206 can be pivoted open about a hinge 404 to allow the battery canister 208 to be inserted in place. A series of stainless steel latches 408 are used to clamp and secure the tow converter 206.

The cables 218 connecting the thrusters 212, ECM 210 and handle bar 204 may be packed into a compartment within the tow converter 206. Alternatively the tow converter 206 may include internal connectivity so that the user can snap the pins together.

The end of the battery canister 208 protrudes from the tow converter 206. The body adapter 202 fits onto the end of the battery canister 208, and the canister head 200 fits onto the end of the body adapter 202. The body adapter's 202 main purpose is to maintain the neutral or provide additional buoyant lift. The size of the body adapter 202 can be customised to carry additional loads attached on the outer rim of the adapter. For example an underwater video/camera may be strapped on top of the body adapter 202. An extended or multiple body adapters may be used for carrying heavy loads.

The canister head 200 is rounded for hydrodynamic efficiency.

Picatinny rail (also known as MIL-STD-1913 rail or STANAG 2324 rail or Tactical Rail) or NATO Accessory Rail (or NAR) can be used to replace tow converter 206 and thrusters can be slotted into these tactical rails and released via spring-loaded knobs or screws for military applications (not shown).

Battery Canister

Figure 5:
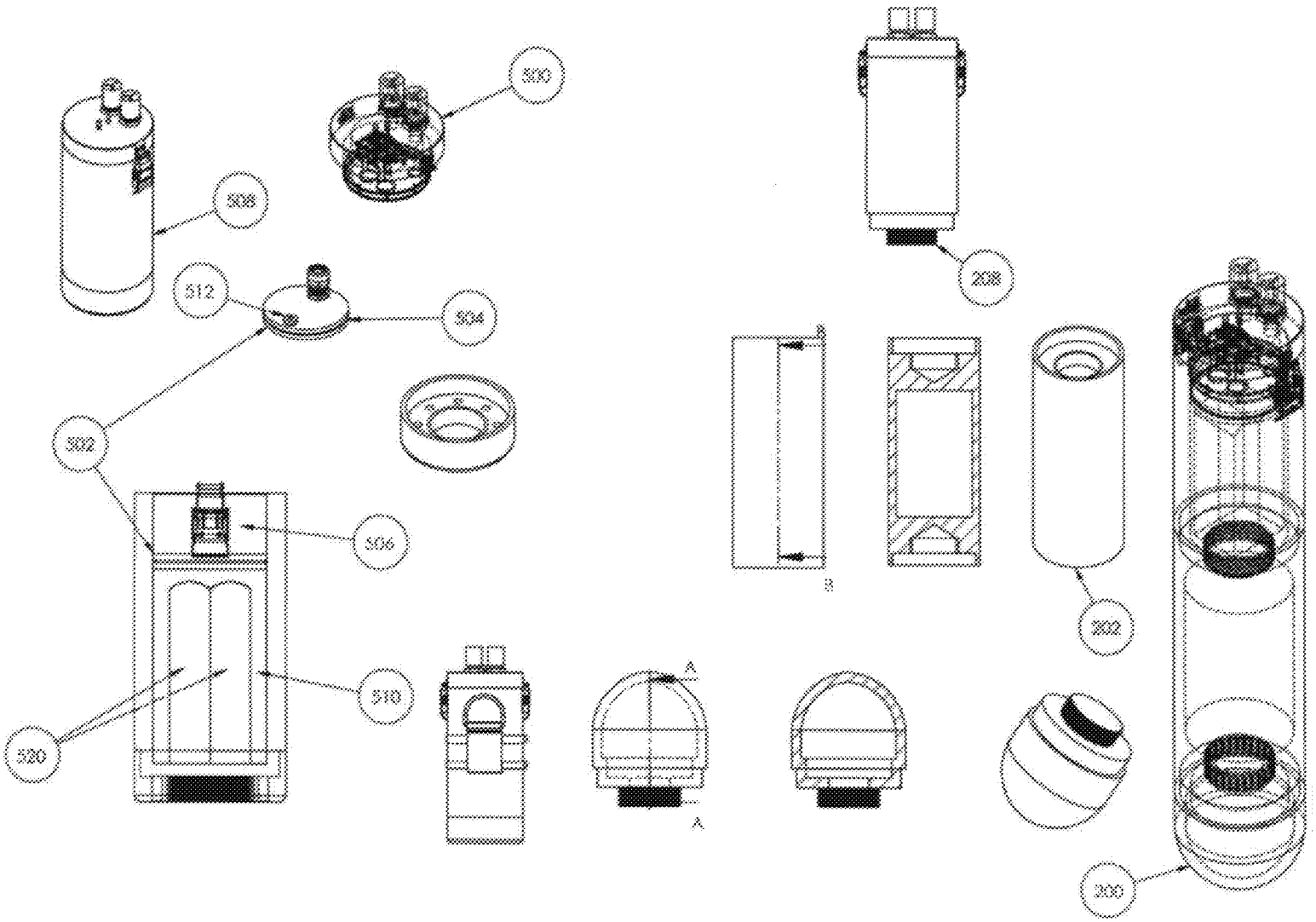
FIG. 5 is an exploded view of the battery canister in FIG. 3.
Figure 6:
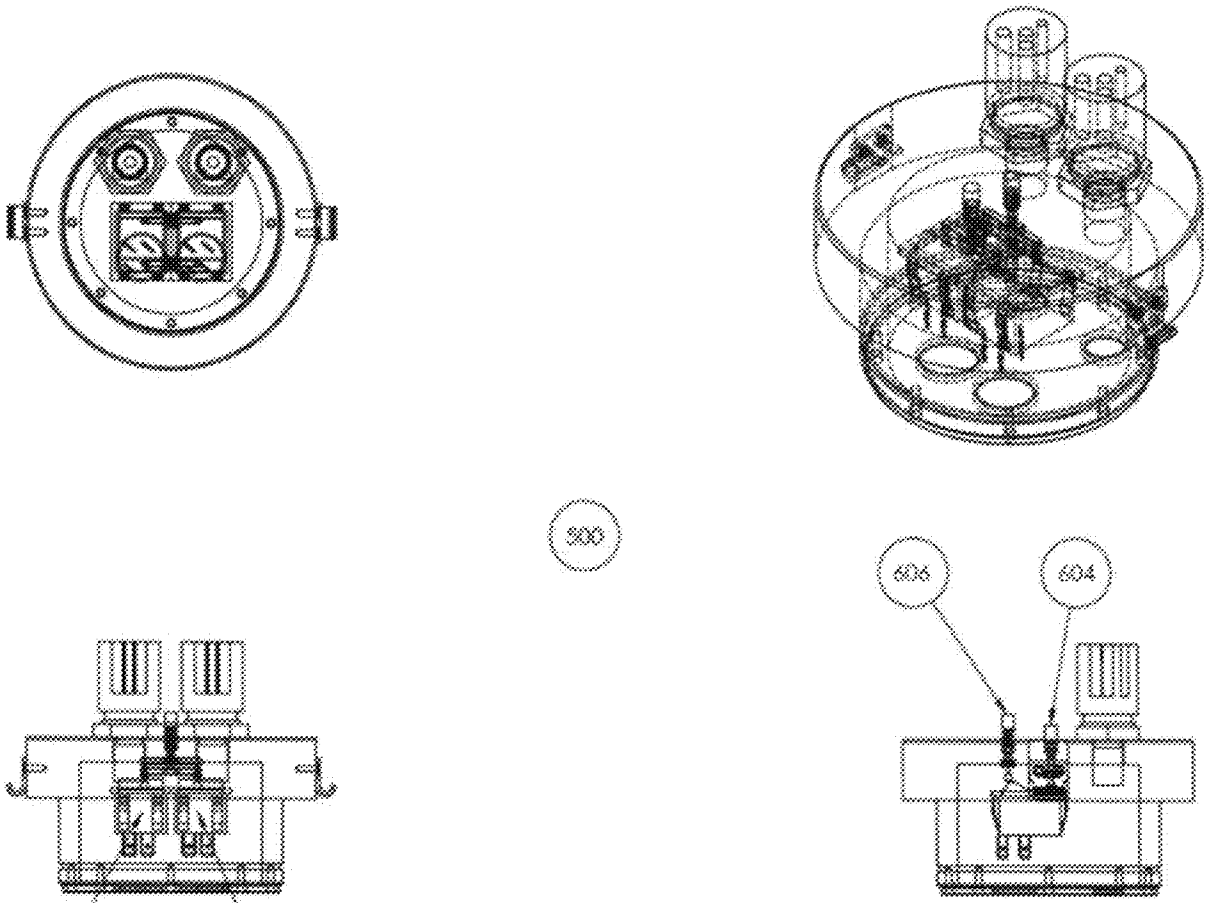
FIG. 6 is a perspective view of the battery canister top cover in FIG. 5.
Figure 7:
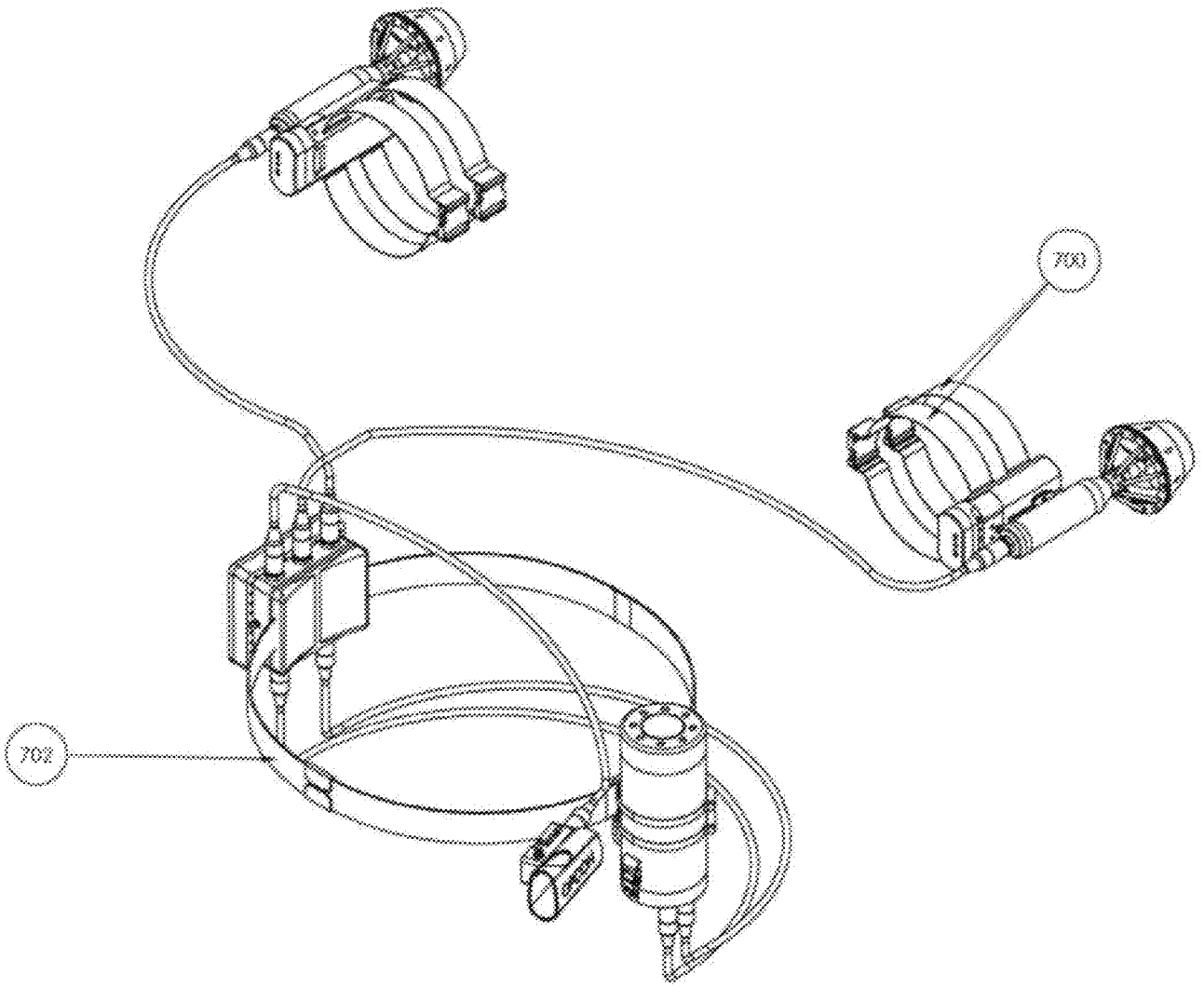
FIG. 7 is a perspective view of the thigh strap configuration in FIG. 1.

The battery canister 208 is shown in more detail in FIGS. 5 and 6. The internal configuration of the in-water battery pack, consists of batteries 520 that may be alkaline, metal hydrides (NiMH), Li-Class families, Lead Acid etc.

The batteries 520 are sealed within the internal compartment by a battery canister top cover 500 to provide first and second level sealing. A secondary sealing cover 502 provides third level sealing. The secondary sealing cover 502 includes O-ring 504 at the top of the battery pack to seal against the inner wall 506 of the outer casing 508.

When deliberately opening the top cover 500, a diver's hands can be dripping wet. The secondary sealing cover 502 prevents water from entering into the battery compartment 510.

When inserting or removing the batteries 520 into the battery compartment 510, air must be able to escape/enter. A port plug 512 is installed on the secondary sealing cover 502, serving two functions.

1) To remove excessive gas build up from the batteries' chemicals, if left over a long period of time in an enclosed compartment. The port plug 512 enables the releasing of hydrogen gas by controlling the gas release, a special thread enables the gas to be released without any damage to the battery pack or user.
2) To allow excessive air flow—at times when diver seals the compartment 510 too tight or dives too deep, air contracts more than it expands after the diver ascends to the surface, so it may be hard to pull out the battery pack. By removing the port plug 512, this allows outside air to fill up the battery compartment for easy removal.

The battery canister 208 may have independent application from the rest of the equipment. For example the battery canister 208 may be used to extend power tools in hazardous areas on land or to provide power for other marine applications.

Thigh Strap Configuration

The thigh strap configuration 700 according to the second embodiment is shown in FIGS. 7 to 10. Each thruster 212 is attached to each quick release adapter 214. Each quick release adapter 214 has straps 810 to attach to the thigh of a diver. Each thruster 212 is electrically connected to the ECM module 210 via cables 218. The cables 218 also electrically connect the battery canister 208 and the hand controller 216 to the ECM module 210. The ECM module 210 and the battery canister 208 are mounted on a waist belt 702.

Thrusters

Figure 8:
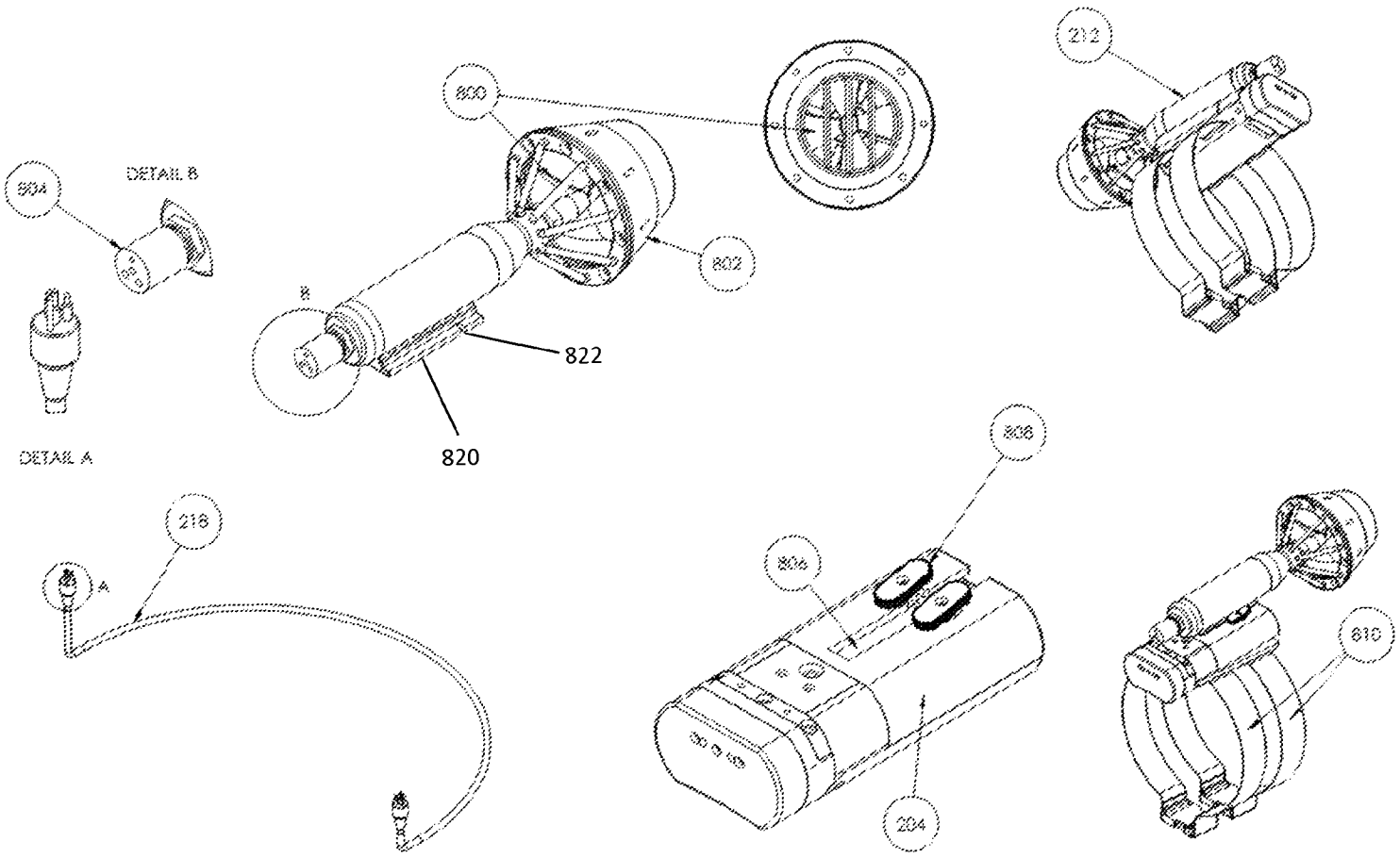
FIG. 8 is an exploded view of the thruster in FIG. 7.

The thruster 212 is shown in more detail in FIG. 8. Thrust is provided by a plastic composite or metallic alloy material driven propeller 800, turbine, jet or pump system. A safety barrier 802 made of high impact plastic composite surrounds the propeller 800. The cables 218 may be underwater releasably connected to the thruster 212 via a female connecter 804.

Figure 22:
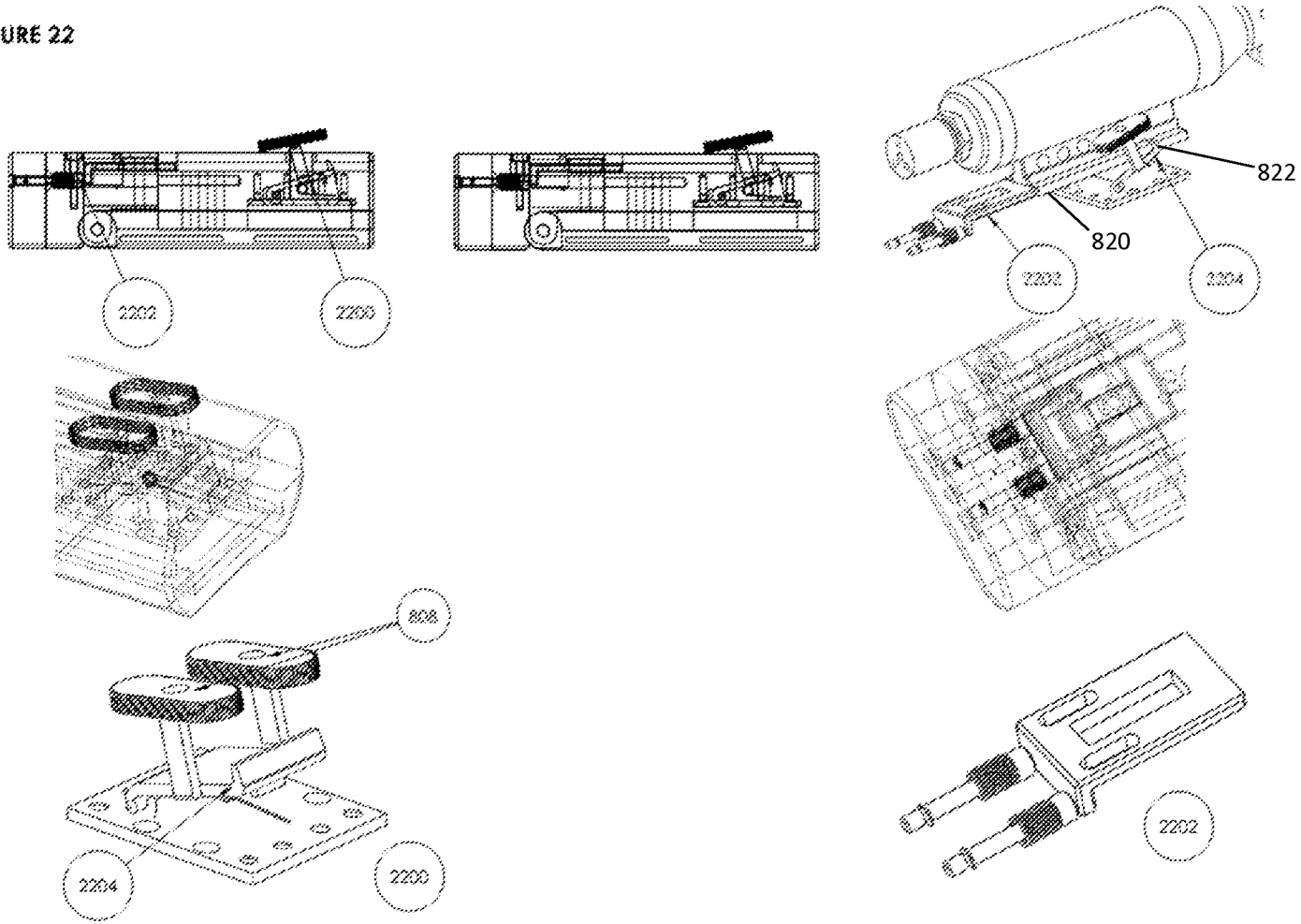
FIG. 22 is a perspective view of the quick release mechanism in FIG. 8.

Each thruster 212 has an engagement portion 820 which slots into a slot 806 in the quick release adapter 214. A quick release button 808 allows the diver to quickly release the thruster 212 in an emergency. FIG. 22 shows how the quick release works by having at least two spring mechanisms. One spring 2200 latches the thruster 212, while another spring 2202 pushes the thruster's hinge 2204 from the bottom. For immediate release, once the button 808 is depressed, the latch 2200 will release, and the bottom spring 2202 will push the thruster's latching gap 822 out of the latching mechanism. In an emergency, the diver may also unplug the cable to cut off the power. The cable is attached even when quick released, as a precaution to reduce the chances of thrusters 212 being lost completely and sinking to the ocean bottom.

Straps 810 are threaded through the quick release adapter 214 to attach around the diver's thigh. The straps 810 are made of fabric materials which may include Kevlar, Nylon and/or Neoprene. They are an ergonomic design to support the thrusters on the thigh muscles. The straps 810 are wear and tear, heat and corrosion resistant.

ECM Module

The ECM module 210 is shown in more detail in FIG. 9. The ECM module 210 is internally oil filled and includes a metal outer surface 900 for heat dissipation. The cables 218 connect to 5 I/O connectors 902. The inner surface 904 is curved for attaching to the waist belt 702 or can be secured to the thigh. A reset switch 906 serves two functions on the ECM, primarily to reboot the JCS computer when battery pack 1600 is changed underwater or any connections are removed and replaced underwater. It also serves as a second level of safety switch.

The ECM module 210 is electrically connected with the battery canister 208 by electrical splash-proof connectors as shown in FIG. 6. Independent power isolators 600, 602 are provided for individual battery or power source. As the battery is capable of discharging an electrical current at a very fast rate, individual power switches depressed by water-proof push buttons 604, 606, prevent the user from touching high power switches 600, 602 with wet fingers within the top cover, providing additional safety in addition to having an on/off switch 402/1004 on the hand bar 204 or hand controller 216. When the high power switches 600, 602 are turned on this will provide power to the ECM module 210. However, only when the on/off switch 402/1004 is turned on, will the ECM module 210 activate the thrusters 212. This provides further safety against accidentally powering of the device by children or dropping from heights, and to reduce the risk of having electric shock.

Hands Free Motion Control

Figure 10:
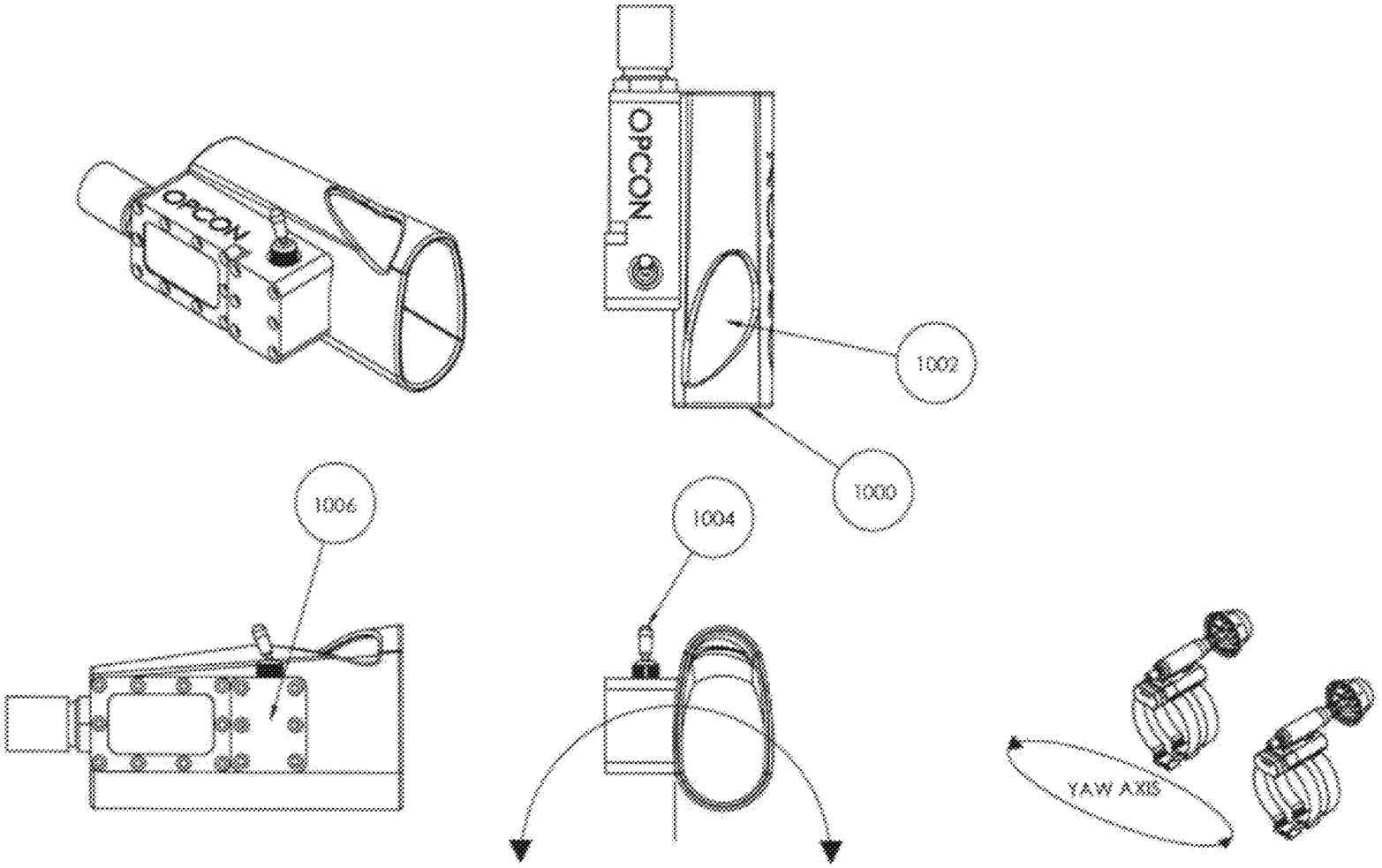
FIG. 10 is a perspective view of the hand controller in FIG. 2.

FIG. 10 shows the hand controller 216 in more detail. The hand controller includes guide 1000 for the diver's hand, and a hole 1002 in the guide for the diver's thumb. An on/off switch 1004, manual/auto switch (not shown) and speed control switch (not shown) can be provided within reach of the diver's thumb.

The switches are US Military approved and the internal components are pressure sealed by resin.

The guide 1000 is fabric material and is curved to follow the shape of the diver's wrist and includes strap(s) to attach firmly around the diver's wrist. Alternatively it may have a hand strap(s) to dangle loosely around the palm. User fingers will extend from the end of the guide, while thumb will exit from the hole 1002.

In auto mode a control module 1006 including an inertia measurement unit (IMU) senses movement of the diver's arm, translates this into speed and direction requests and sends control signals to each thruster 212 accordingly. The IMU is placed approximately above, along the side, or parallel to the radius bone of the diver or being installed on a flat surface area parallel to the act of motion, permitting the arm to perform like a joystick or any parts of the user's body (e.g. on a dive helmet). The location of the IMU is based on the ergonomics and anatomy of average adult hand wrist and bone structure, including the angle of wrist to hand and thickness of the hands and thumb.

Various different hand movements can be used to translate to control the thrusters 212. For example a left rotation of the wrist translates to a left turn and a right rotation of the wrist translates to a right turn. A double forward knocking motion can translate to emergency stop. Each thruster 212 power can then be adjusted or preset by the computer to rotate clockwise (CW) and counter clockwise (CCW) at independent speeds accordingly.

Figure 23:
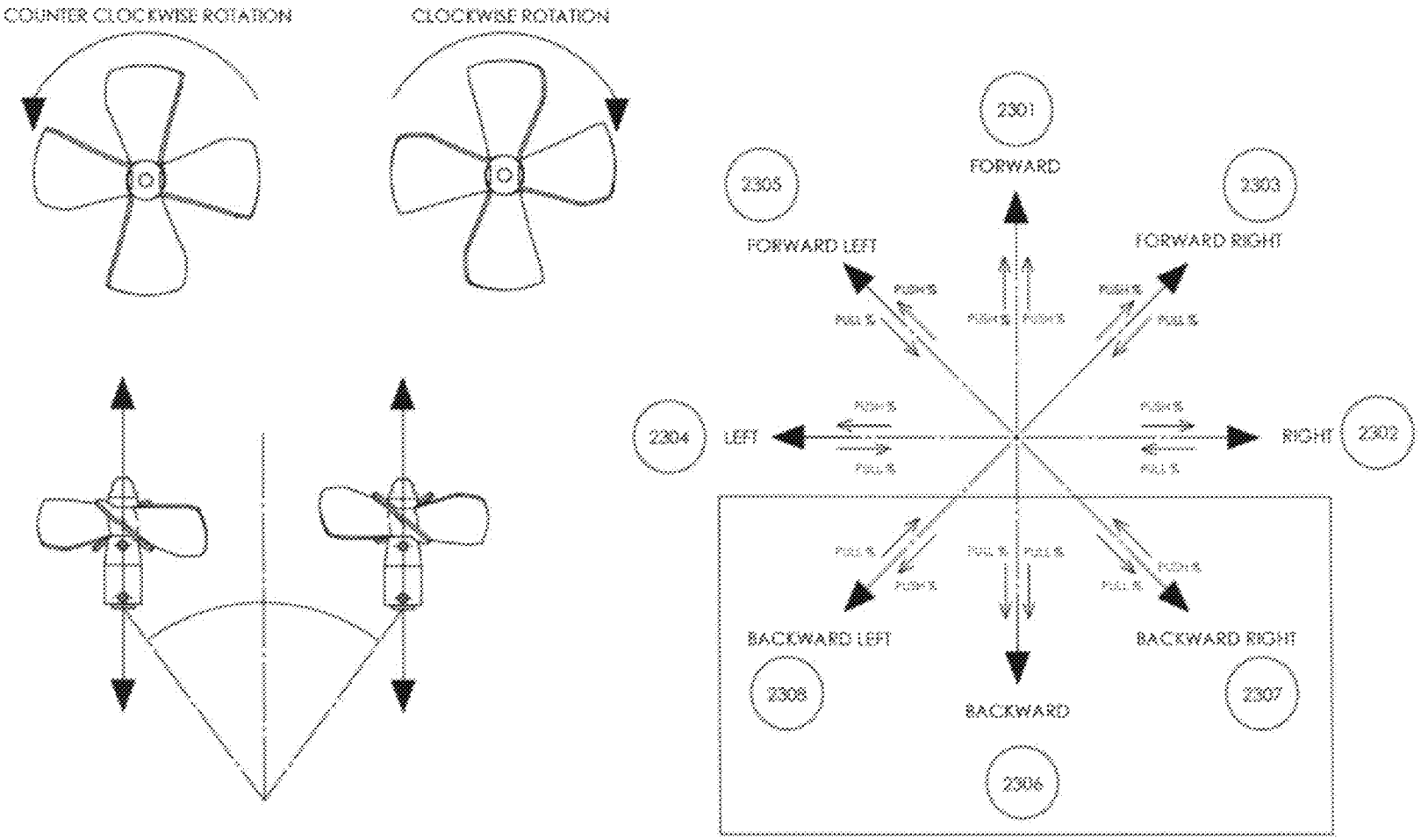
FIG. 23 is a schematic diagram of the directional control using the hand controller in FIG. 10.

For normal forward motion, the two propeller blades are counter-rotating to each other, which cancels out thruster torque for travelling in a "straight" line only. If the power delivered to each thruster is adjusted independently, various different directions may be achieved. This is achieved by preset speeds and programmed into the ECM module 210. For example 8 different directions are shown in FIG. 23:

- 2301 Forward thrust: two thrusters turning in the opposite directions (counter-rotating to each propeller) to "push" user (diver and/or swimmer) forward
- 2302 Right thrust: Left-side thruster will "push" the user forward, while Right-side thruster will either "pull" backward or stop—no power (act as pivot)
- 2303 Forward-Right thrust: By combining Right (as mentioned in 2302**) motion with speed adjustment and user body-twisting motion to the angle of flow, resulting banking motion (like an aircraft banking right).
- 2304 Left thrust: Right-side thruster will "push" the user forward, while Left-side thruster will either "pull" backward or stop (act as pivot)
- 2305 Forward-Left thrust: By combining Left (as mentioned in 2304**) motion with speed adjustment and user body-twisting motion to the angle of flow, resulting banking motion (like an aircraft banking left)
- 2306 *Backward thrust: two thrusters turning in reverse directions to "pull" swimmer backward.
- 2307 *Backward-Right thrust: Reverse direction of Forward-Left
- 2308 *Backward-Left thrust: Reverse direction of Forward-Right

*Applicable only to swimmer, as diver's fins can cause a lot of drag and eventually damage the ECM module and thrusters.

**In order for the user to turn in a certain angle, a preset power will be programmed into the computer to command individual thruster to drive in a preset power—e.g. to turn forward right, the "push" thruster will deliver 100% power while the "pull" thruster will deliver lower power than the "push" thrusters so as to act like a pivot (much like a bull dozer steering) while the user's body twists with the angle of flow (motor biker needs to lower the body when turning at a sharper angle) and speed will then propel the user to the direction.

The user must also control the speed in order to determine the direction of travel, else user will circle on a dead spot.

The automatic mode may greatly reduce diver's fatigue load, and permit confined space maneuvers during restricted finning of the legs when strapped with other equipment.

Because the hand controller 216 straps to the wrist of the diver, the diver's fingers are still free. Thus the diver can still hold or operate other dive equipment in that hand.

For recreational applications, the on/off switch 402/1004 is turned on in a backward position (towards the diver), which is slightly more difficult than the turn off forward position (away from the diver). This allows the diver the more natural actuation of pushing forward, for an immediate stop or emergency brake.

The ECM module 210 may include sensors, for example water speed sensors or depth sensors. The hand controller 216 may include an LCD panel with GUI (Graphic User Interface) and/or touch interactivity. Information can then be packaged and transmitted through the ECM module 210 via wireless transmission (Radio-Frequency) and decoded by control module 1006 at the diver's wrist. The system can also relay a power signal (RF may be limited in water up to 1 m) by transmitting information from the ECM module 210 to the hand controller 216 and/or display information on a diver's mask (like head-up display). Depending on the application eg: sports, technical, commercial, military, different information may be gathered and/or displayed.

Hand controller 216 including motion-sensing can also be used as a manipulator for human-like movement, for any turret system mounting equipment (like apache attack helicopter pilot's helmet controlling the machine gun, the machine gun mounted will follow the direction where the pilot is looking). The equipment can be controlled by motion sensing, joystick-controlled, both wired or wire-less. This might be used in fire-fighting or rescue operations, or deep sea remote operated vehicles where the situation is hazardous. The motors that provide "CW" and "CCW" directions, can also be combined with or switched to actuators for "Pushing" and "Pulling" motions.

Calf Strap Configuration

Figure 11:
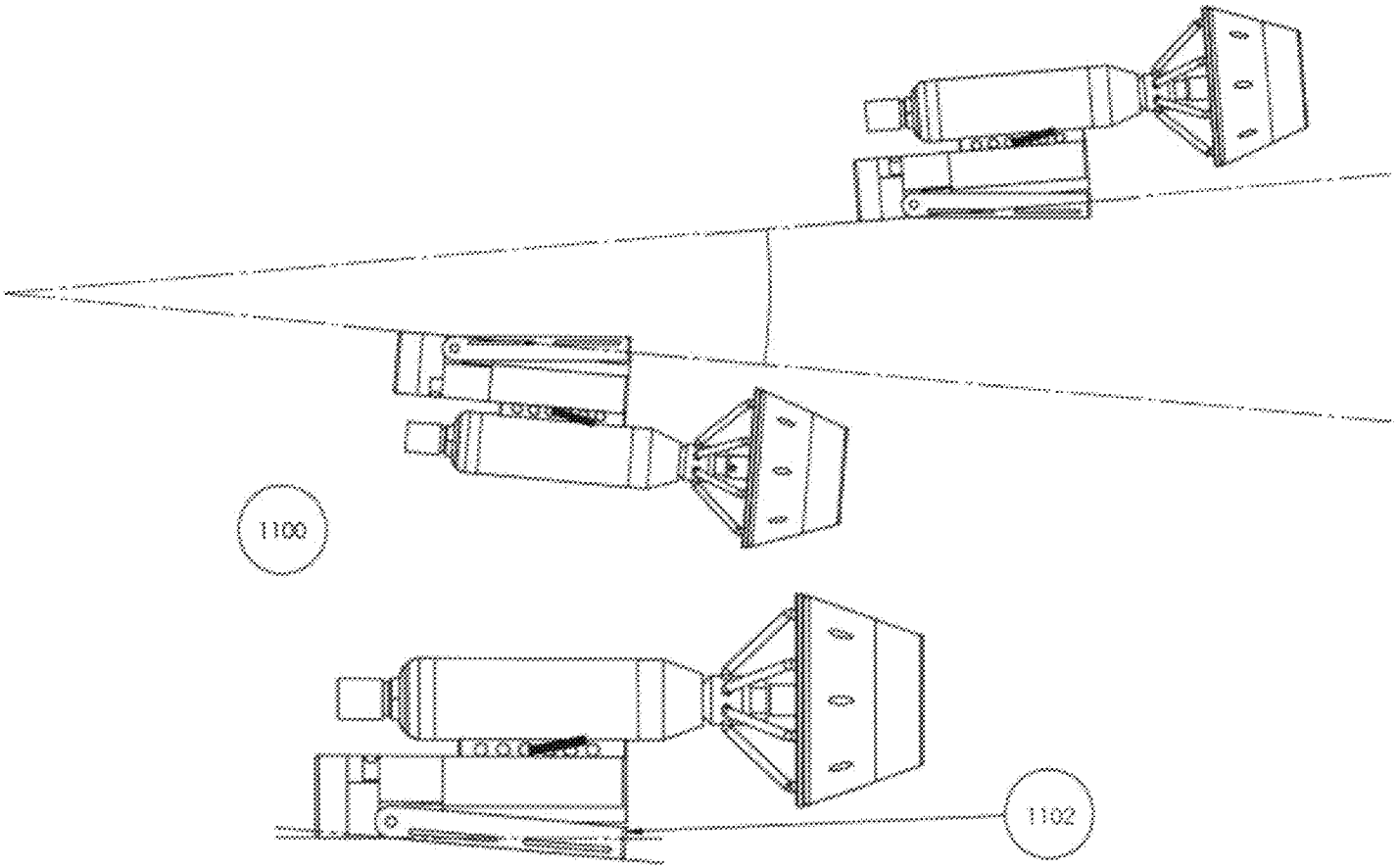
FIG. 11 is a perspective view of the calf strap configuration in FIG. 1.

In the calf strap configuration 1100 shown in FIG. 11, the straps 810 are attached to the calf of the diver instead of the thigh. In that case the quick release adapter 214 includes a hinged mechanism 1102 to angle the propeller backwash away from the divers calf and the fin attached to the diver's foot. The angle may for example be between 3-45°. The hinged mechanism 1102 is released by a button (not shown). Otherwise this is similar to the thigh strap configuration 700.

Push Configuration

Figure 12:
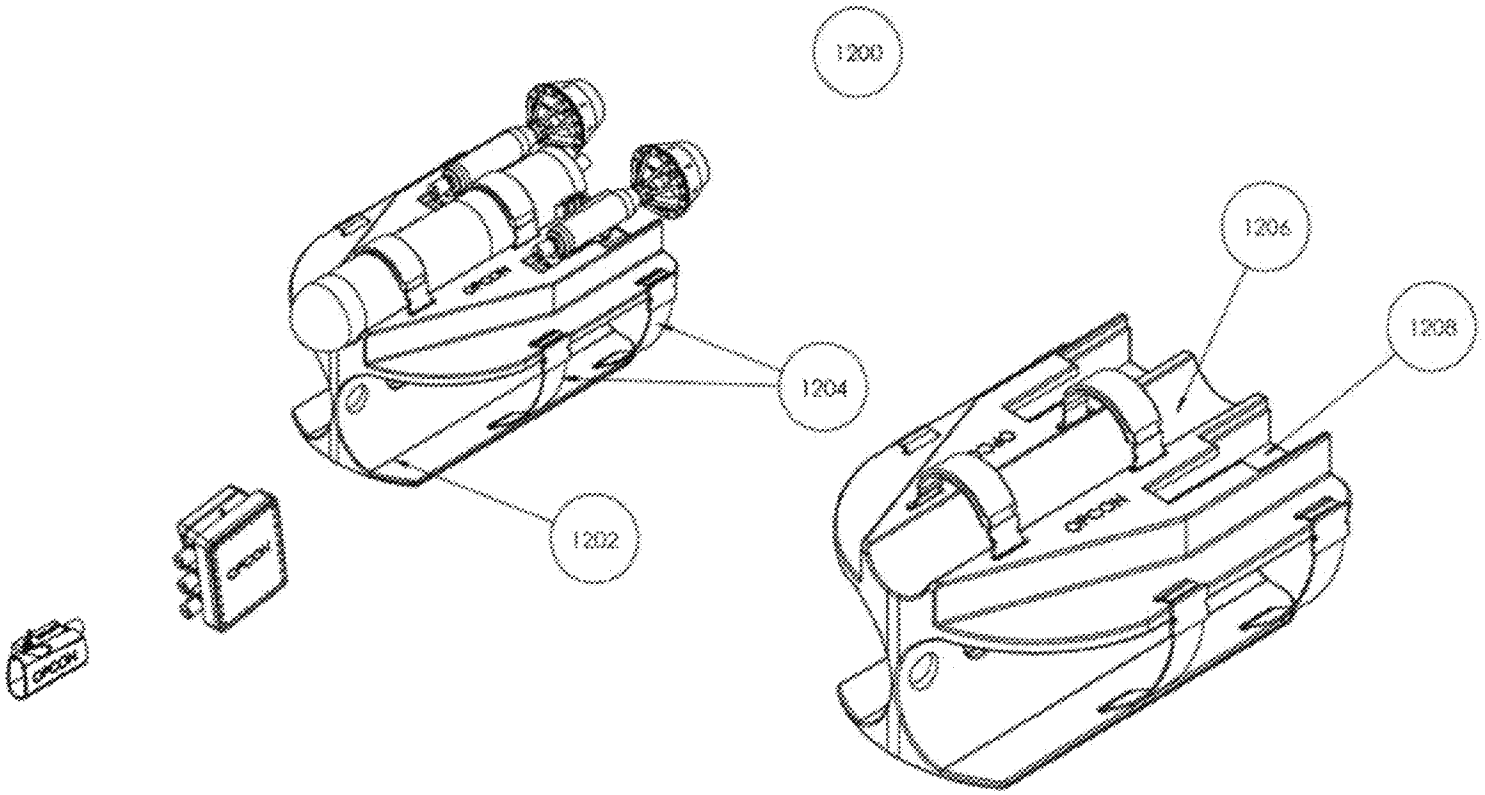
FIG. 12 is a perspective view of the push configuration in FIG. 1.

The push configuration 1200 is shown in FIG. 12. The push converter 220 (also called a saddle bar, scooter saddle or simply a saddle) has channels 1202 either side to accommodate the diver's thighs, and straps 1204 attach over the outside to secure the push converter 220 to the thighs. The battery canister 208, body adapter 202 and the canister head 200 fit into a channel 1206 on top of the push converter 220. On either side of the channel 1206 slots 1208 are provided to house each quick release adapter 214, to which in turn each thruster 212 is attached to. The ECM module 210 is attached to the diver's waist belt 702. The ECM module 210 and hand controller 216 are connected to the battery canister 208 and each thruster 212 via the cables 218.

Tank Mount Configuration

Figure 13:
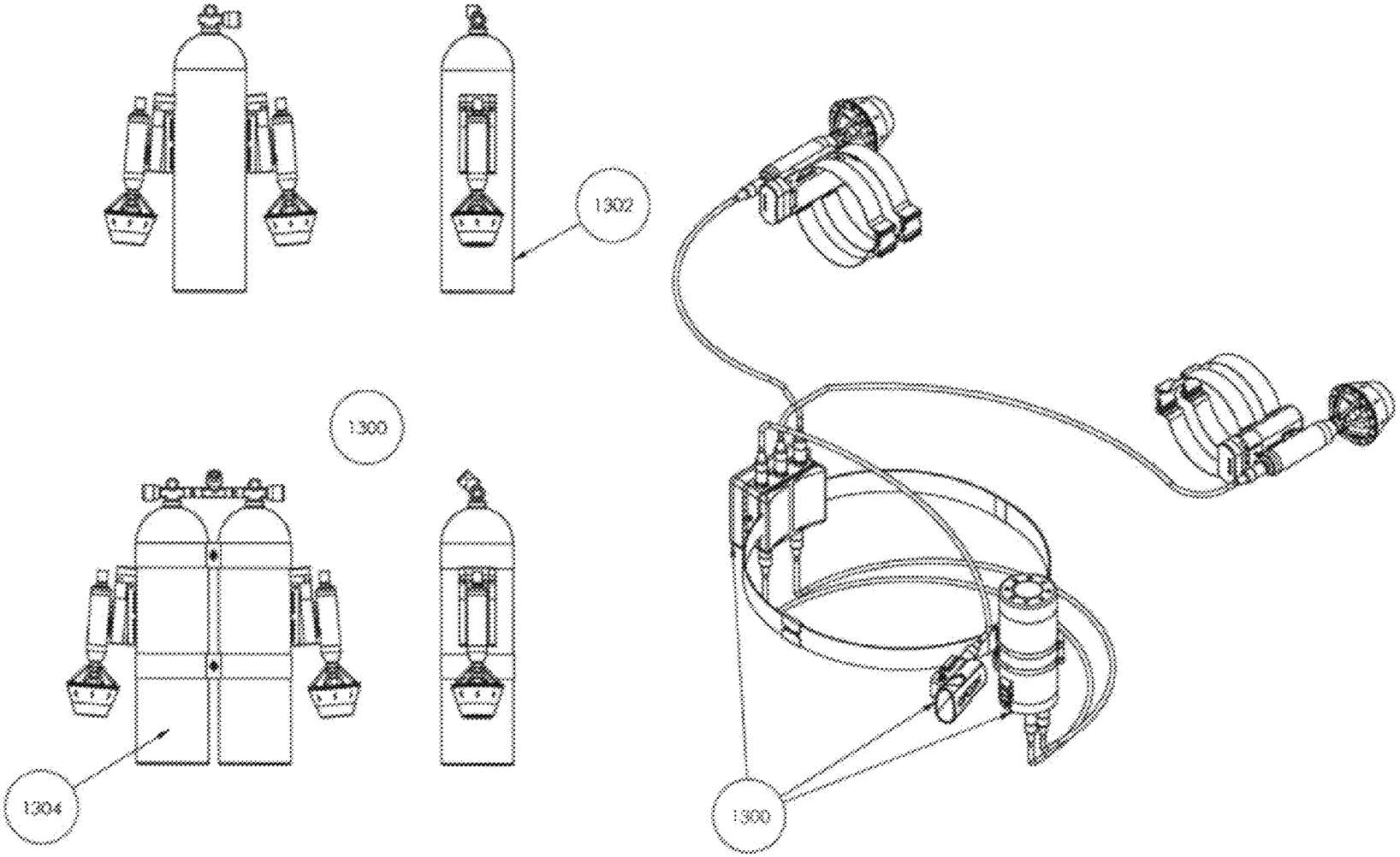
FIG. 13 is a perspective view of the tank mount configuration in FIG. 1.

The tank mount configuration 1300 shown in FIG. 13 is similar to the thigh strap configuration 700, except that the straps 810 are used to strap to the tank 1302, to a double tank system 1304 or a rebreather unit. Also customized attachments can be designed to accommodate different apparatus.

Headlight Canister

Figure 14:
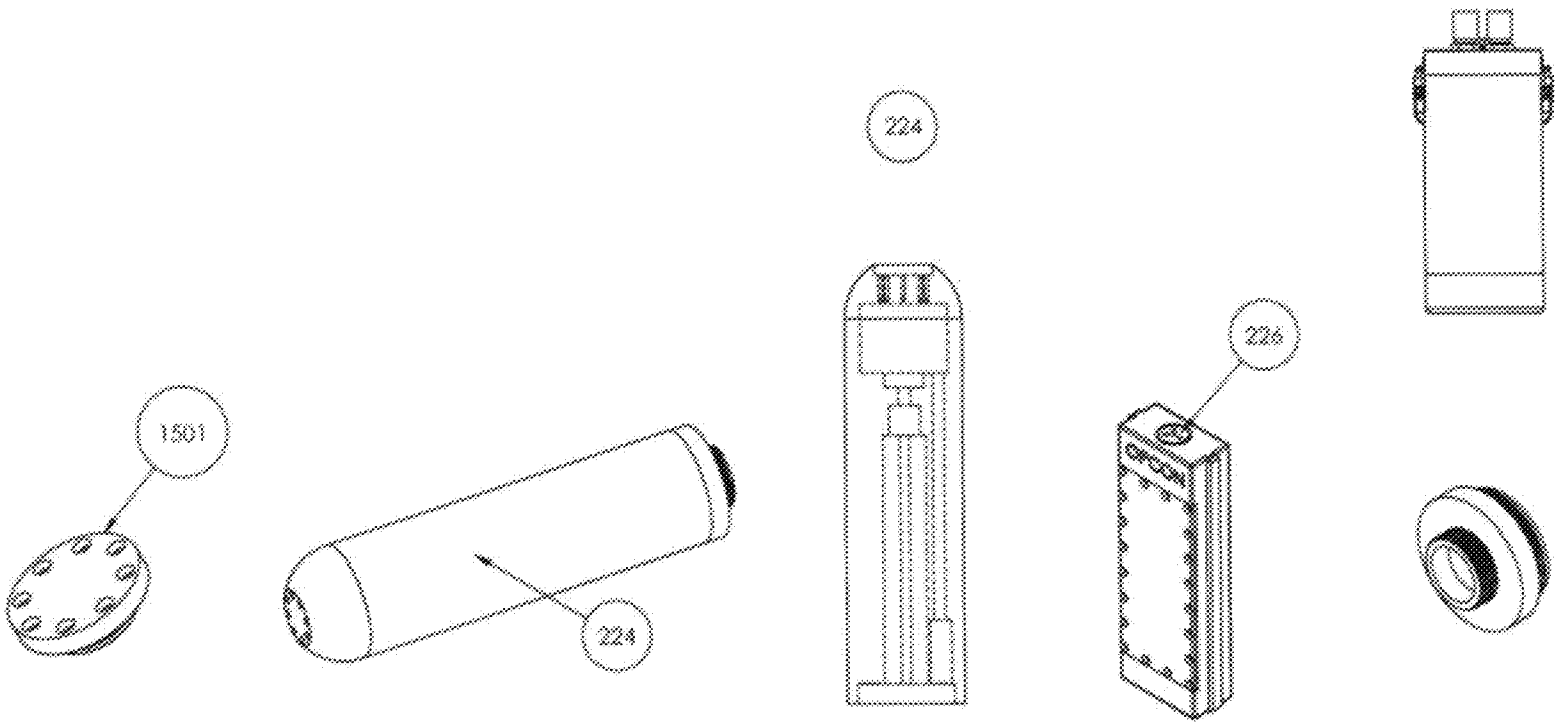
FIG. 14 is an exploded view of the head light module in FIG. 2.
Figure 15:
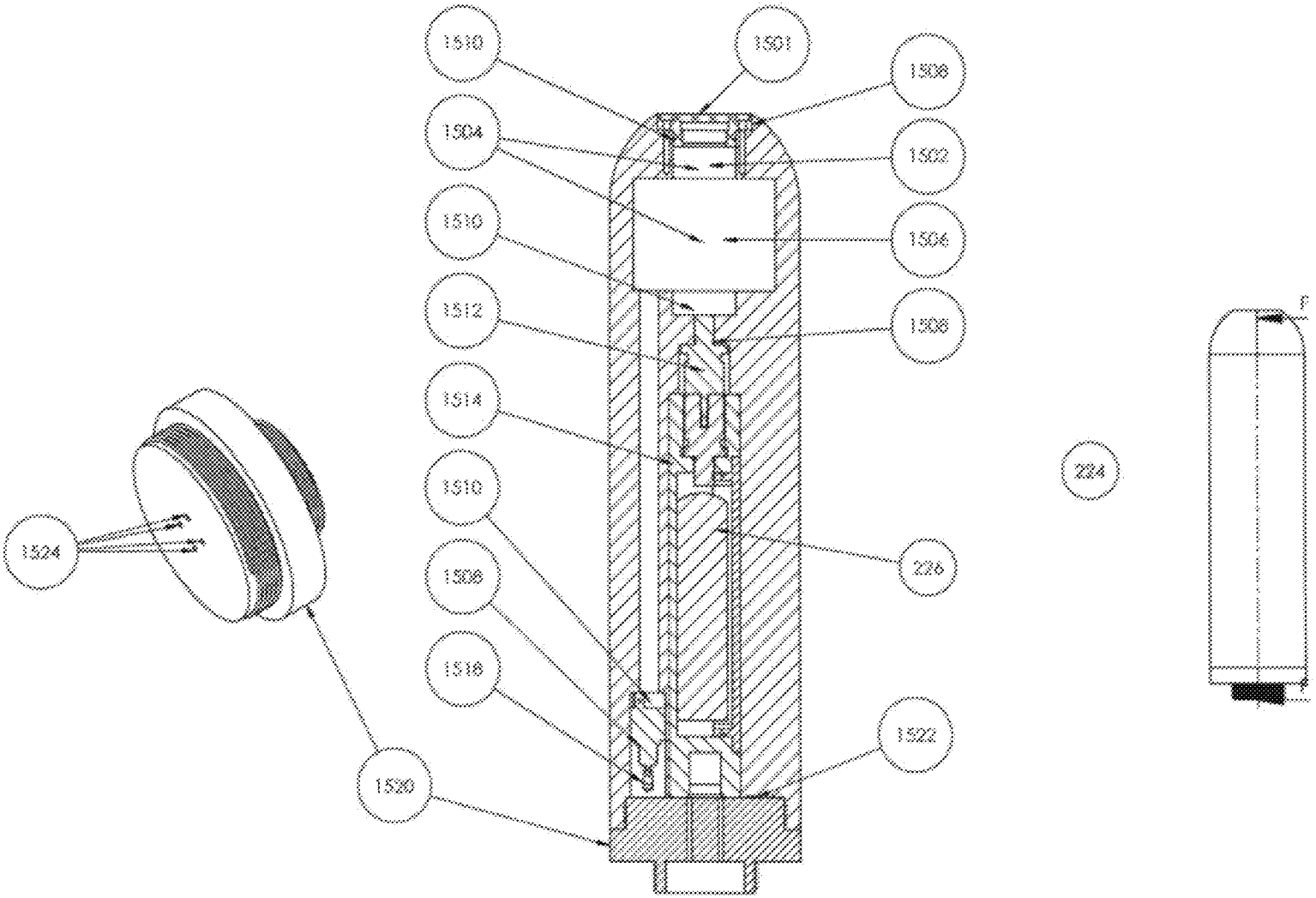
FIG. 15 is a section view of the head light module in FIG. 14.

FIGS. 14 and 15 show a headlight canister 224 that can be used for the tow/pull type scooter. The body adapter 202 and the canister head 200, are substituted for the headlight canister 224.

The headlight canister 224 is independent similar to a dive torch except it must be neutral or positive buoyant, or to be compensated by other means to balance the buoyancy.

The headlight canister 224 includes transparent plastic faceplate 1501, a bulb 1502 in its front section 1504, circuitry on a PCB 1506, first seal 1508, a second seal 1510, and underwater water pluggable connector 1512 from the PCB 1506 into a battery compartment 1514, a separate underwater changeable battery 226, a waterproof switch 1518 and an end cover 1520 to seal the battery compartment 1514. The bulb 1502 may be H.I.D., Halogen, LEDs, etc.

A reduced space gap 1522 is designed between the waterproof switch 1518 and the end cover. The end cover 1520 also includes small holes 1524 for funneling seawater out when the end cover 1520 is being secured. As sea water is being compressed and funneled out of the holes 1524, the reduced space gap 1522 is so small that sunlight and seawater will not be able to get/flow in. This removes the chances of marine growth. Also, the small holes 1524 do not allow seawater to flow in easily as the battery compartment and outside ambient pressure remains the same, therefore seawater is not being compressed to flow into the small holes 1524.

This method reduces the chances of marine growth (e.g. barnacles) within the battery compartment 1514 where the underwater switch 1518 and battery 226 is. The reduced space gap 1522 cuts off sunlight, reduces oxygen and nutrients in the water, and prevents marine growth.

The headlight canister 224 can be applied for any marine application that requires power and submersion in sea water for a prolonged period of time.

Underwater Changeable Battery

Figure 16:
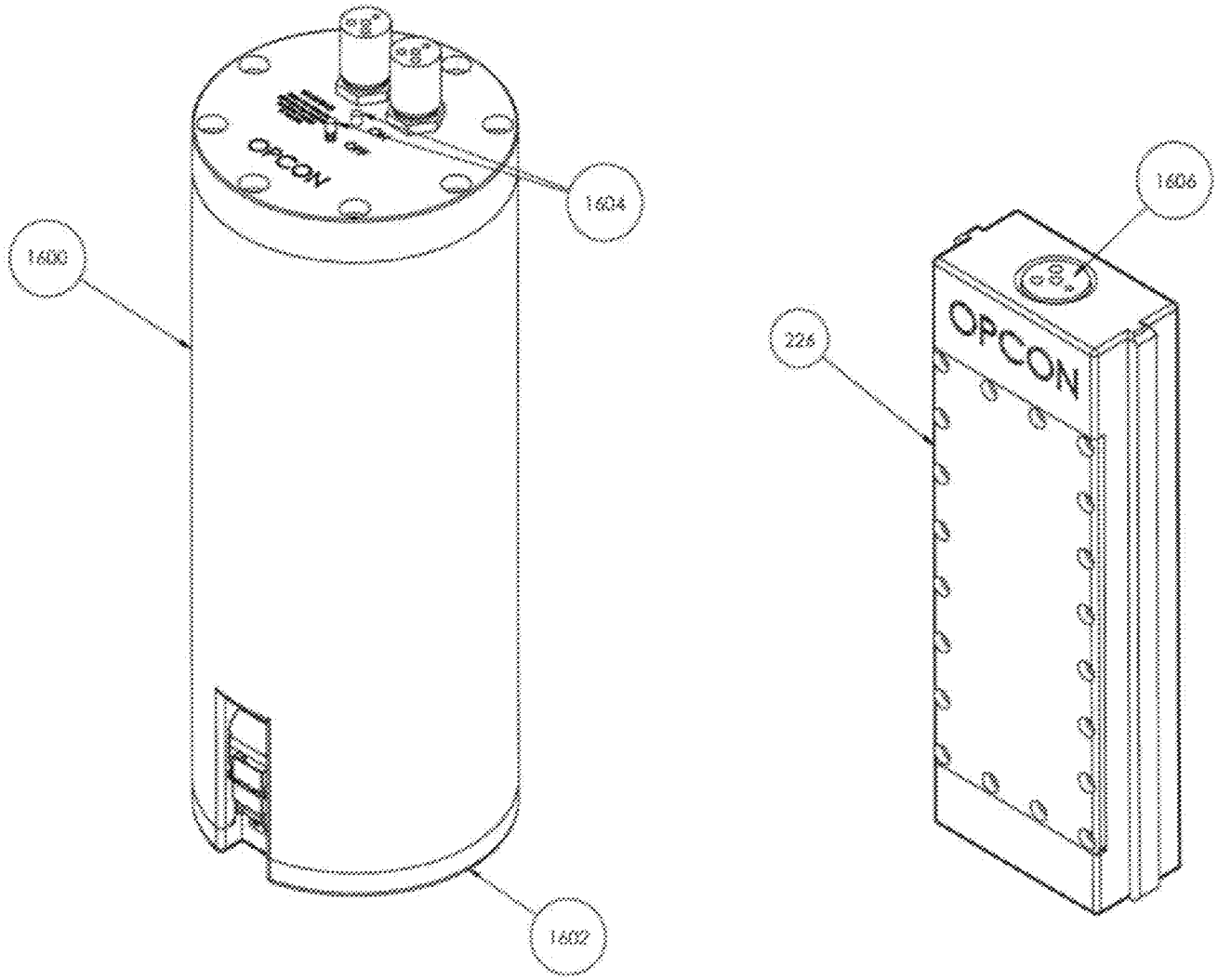
FIG. 16 is a perspective view of the underwater changeable battery canister in FIG. 1.
Figure 17:
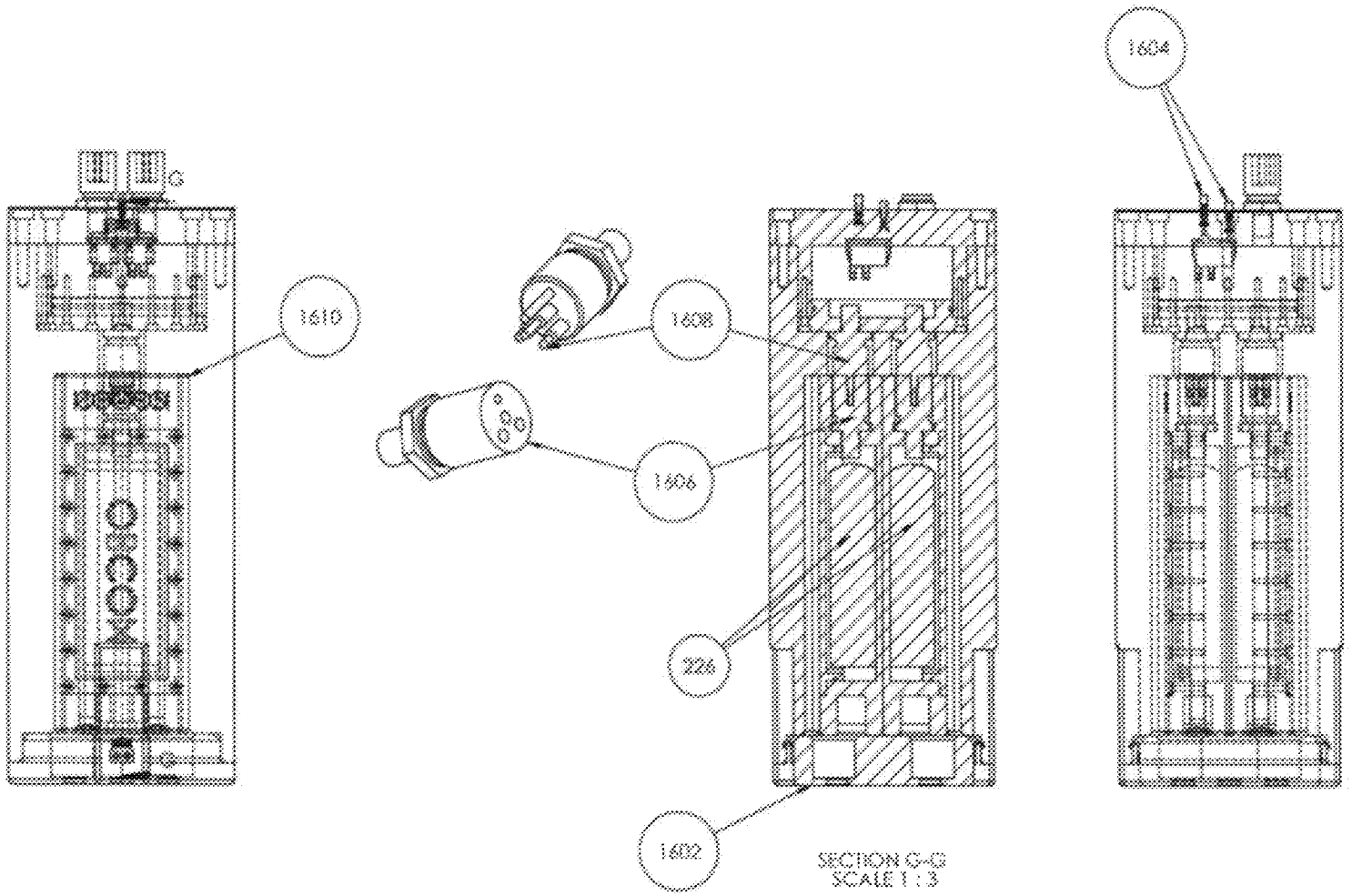
FIG. 17 is a section view of the underwater changeable battery canister in FIG. 16.
Figure 18:
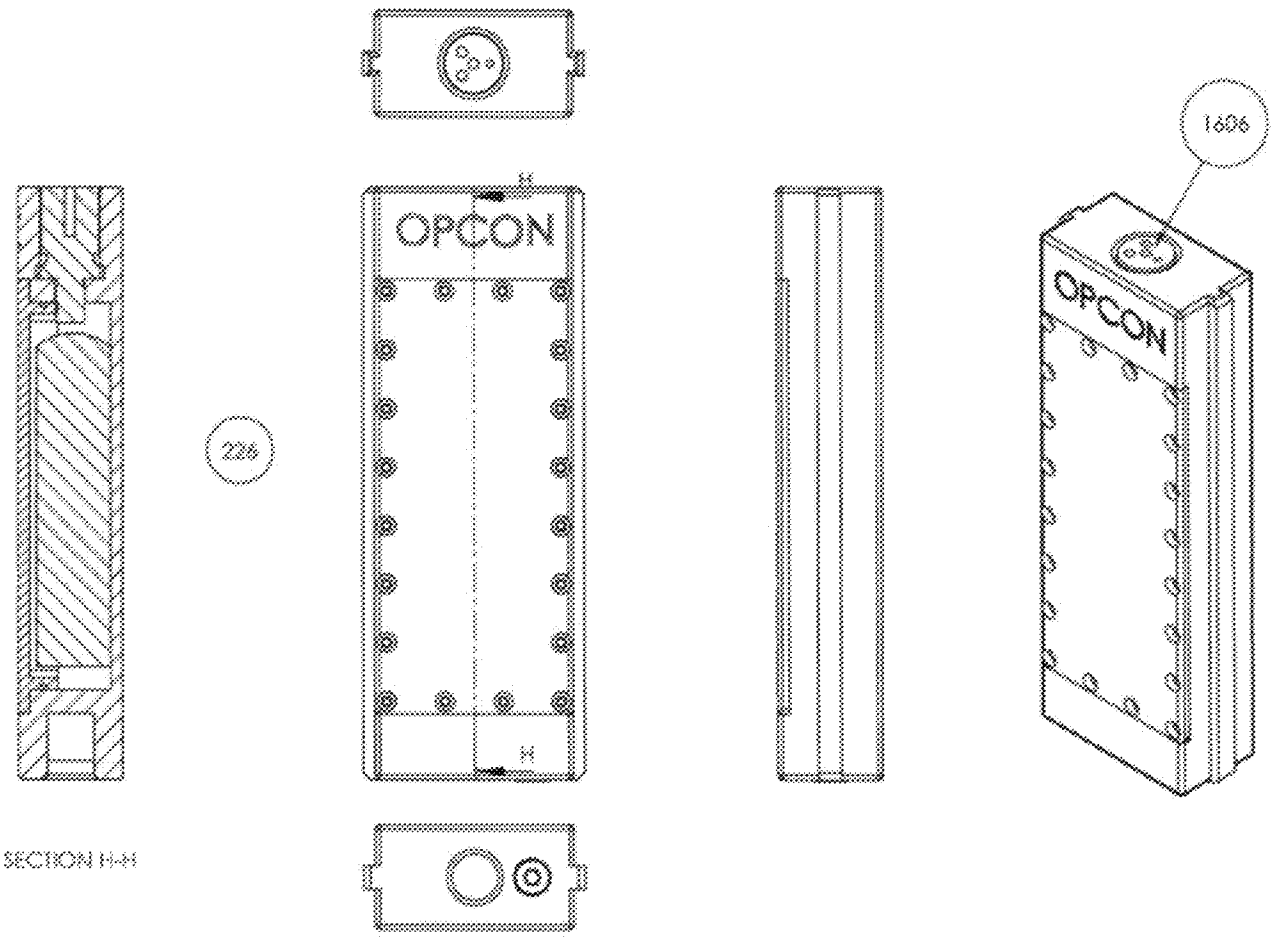
FIG. 18 is a section view of the battery in FIG. 16.

The underwater changeable battery canister 1600 shown in FIGS. 16 to 18 can be used in place of the battery canister 208 mentioned above. In this case, two or more waterproof battery packs 226 may be changed under water to allow the diver to extend bottom travel distance without having spare scooters or surfacing.

To change the battery:

1) Turn off power—by pressing on the water-proof push-button 1604 (flip the underwater switch 1518 for front mount headlight 224). Power must be cut off before changing battery, as it can damage circuitry and/or electric shock to user.
2) Unclip the end cover 1602 for underwater changeable battery (or unscrew the end cover 1520 for front mount headlight 224).
3) After turning off power, use the index finger to pull the In-water changeable battery pack 226 out (both In-water changeable battery canister and front mount headlight use the same waterproof battery pack(s) 226).
4) The In-water changeable battery pack 226 has a female connector 1606 which is self-sealing, once pulled out from the male connector 1608.
5) A new in-water battery 226 is inserted using a slot 1610 to guide the battery pack(s) in place. Only with a correct slot position will the male connector's 1608 pins match exactly to the female connector 1606 of the battery pack 226.
6) Secure back the end cover 1602/1520 to prevent battery pack 226 from falling off.
7) Once connected, user can turn the power button 1604/1518 back on.

Control Strategy

Figure 19:
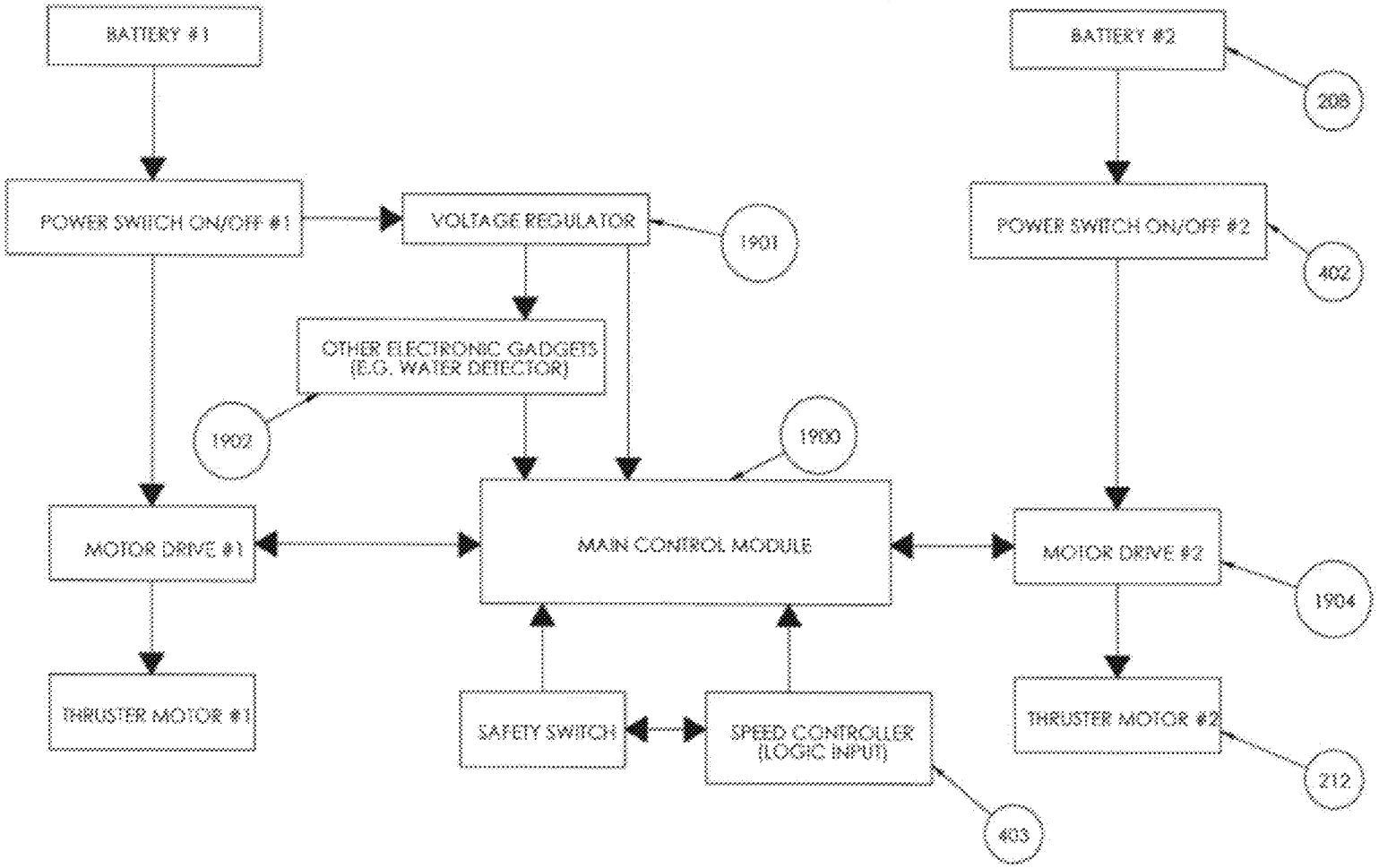
FIG. 19 is a flow diagram of the control strategy for recreational applications.

Different control strategies may be employed depending on the application and user requirements. For example, for recreation applications (up to 40 m depth rating) the ECM module 210 might be programmed as shown in FIG. 19. The main controller 1900 receives power from the battery canister 208, via a voltage regulator 1901, which may also power other electronics 1902. In turn the main controller 1900 is connected to the on/off switch 402/1004 and the speed control knob 403, and provides control signals to a motor driver ESC 1904. Each motor driver ESC 1904 receives power from a respective battery canister 208, and sends an appropriate drive signal to each thruster 212.

Figure 20:
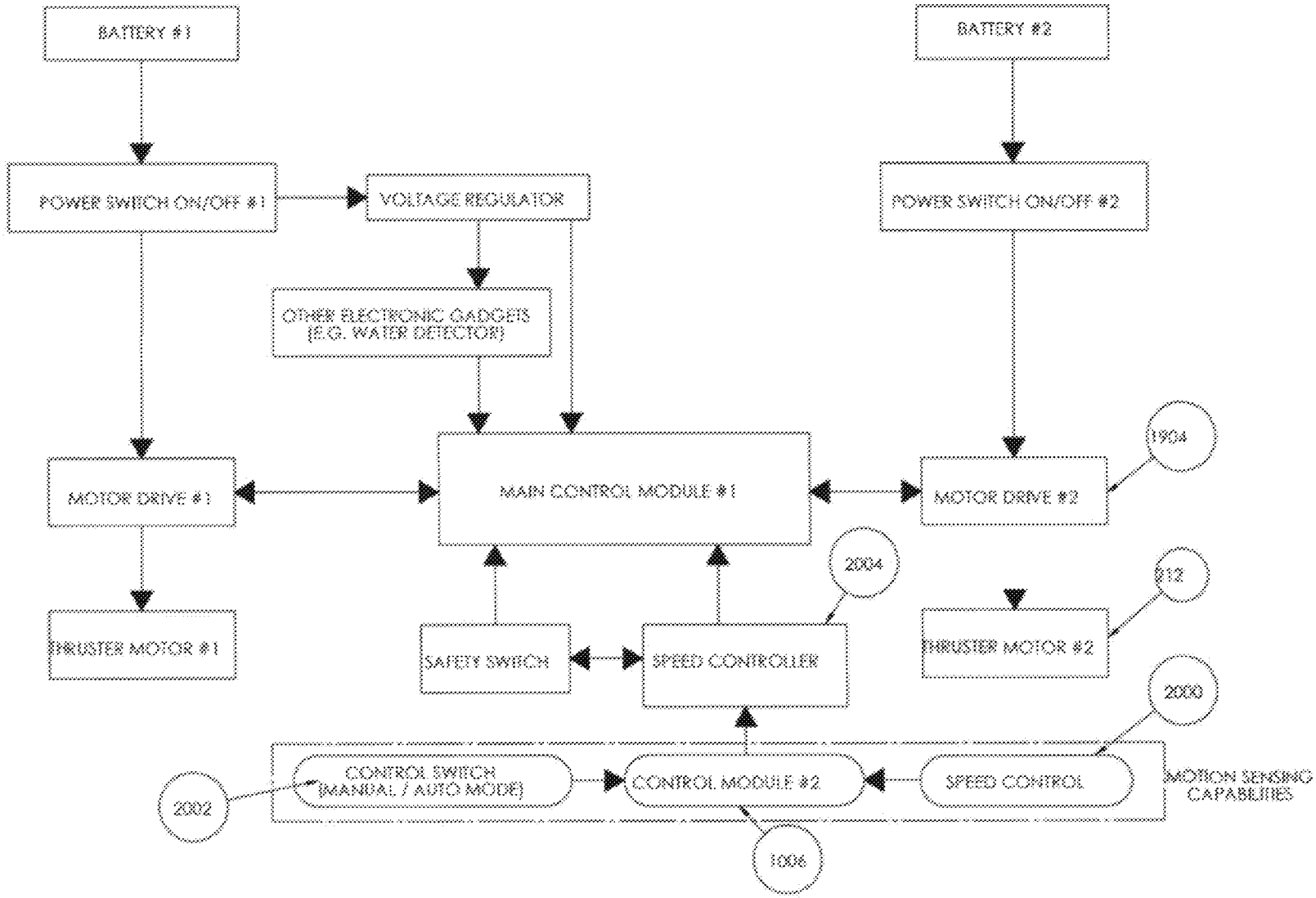
FIG. 20 is a flow diagram of the control strategy for technical applications.

For technical diving or advanced applications (up to 120 m depth rating), the ECM module 210 might be programmed as shown in FIG. 20. The control is similar to FIG. 19, except that the main controller 1900 receives speed control signals from the control module 1006. Control module 1006 includes motion sensing capabilities from the integrated IMU. Speed control 2000 and mode switching 2002 are also input to control module 1006.

The IMU uses a combination of accelerometers and gyroscopes to measure the changes of angle in which the user turns the wrist or movement of the body. Thus angle motion produces analog signals to the control module 1006. The control module 1006 will then convert the differential analog signals to digital signals, compile and relay the information to the speed controller 2004. The main controller 1900 will decode and analyze the digital signals and transmit to the motor driver/ESC 1904. The ESC 1904 converts the decoded digital signals to digital frequency and generates pulse width modulated power waveforms for the BLDC motor in the thruster 212. The refresh rate is performed in milliseconds.

The speed control 2000 is analog, the control module 1006 adjusts the voltage difference and computes the difference. The input speed is measured in the difference of the voltage range, e.g. 0 Vdc to 5 Vdc, the speed controller 2004 will calculate this difference voltage range and convert this into binary and send it back to main control module 1900. As the speed control must be constantly monitored by control module 1006, this function is taken off from main control module 1900 to reduce traffic. The main controller 1900 will then compile the voltage difference (for speed) and decoded signal (for motion signal) to the motor driver/ESC 1904. The ESC 1904 will finalize the results, convert them into the digital frequency and generate the required pulse signals for the BLDC motor in the thruster 212.

Control module 1006 includes an analog-to-digital converter, which converts the analog signals from the IMU to digital signals. Main controller 1900 performs multiple tasks, analyzing and monitoring the entire system. Having two control modules reduces the work load and reduces the chances of total malfunction due to overload.

Figure 21:
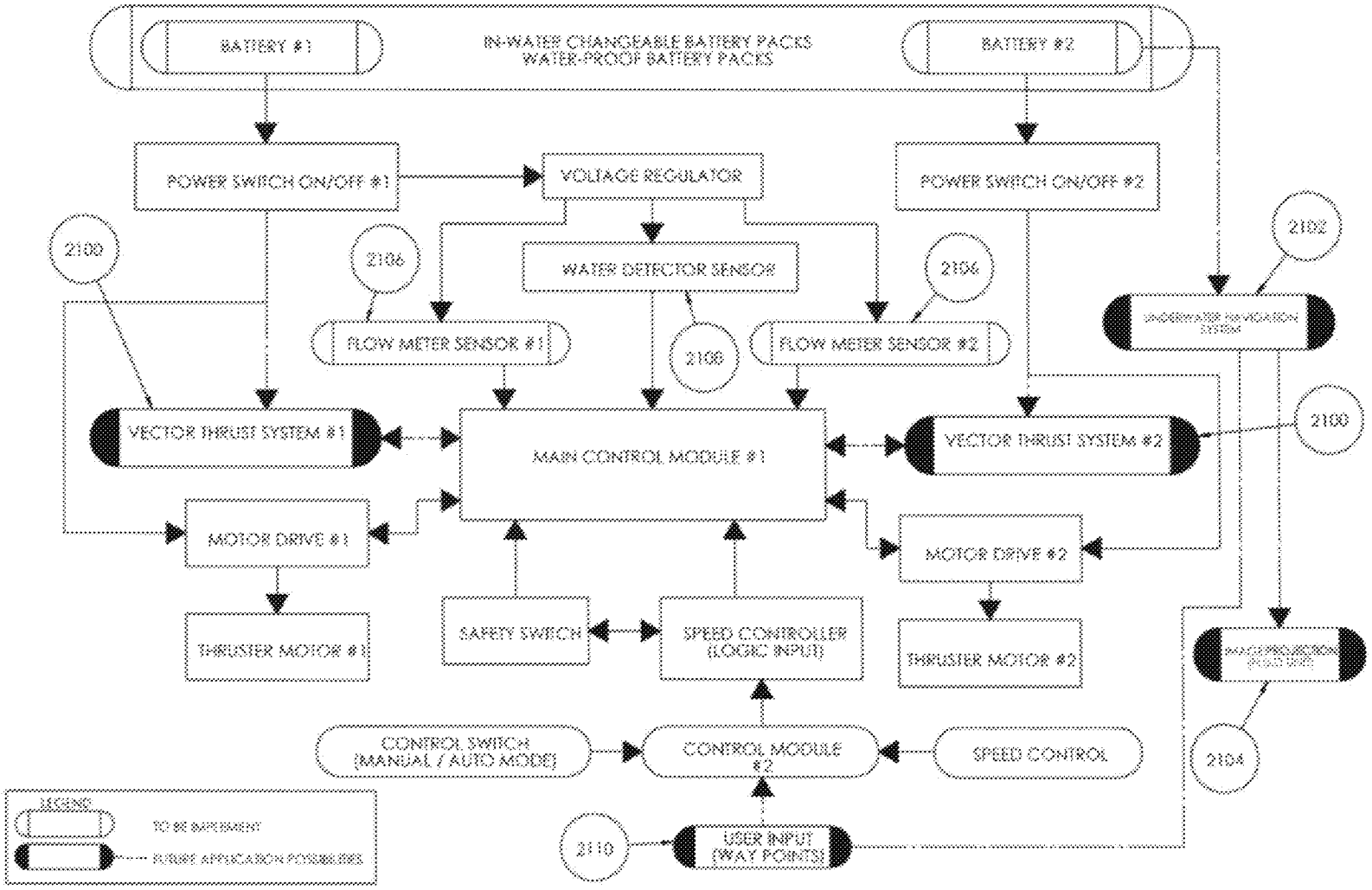
FIG. 21 is a flow diagram of the control strategy for military applications.

For military applications (customized depth rating), the ECM module 210 might be programmed as shown in FIG. 21. The control is similar to FIG. 20, with the addition of a vector thrust system 2100, underwater navigation system 2102, an underwater HUD unit 2104, flow meters 2106, water detectors 2108, and user input waypoints 2110.

With the introduction of motion-sensing control in Technical/Advanced applications, it creates wide applications such as:

1) Flow meters 2106—used to provide reading of the thruster when water flows through the sensor(s) mounted on each thrusters.
2) Water detectors 2108—used to monitor any leakage within the JCS system. When water is detected, the LED and/or buzzer will activate. In the event the safety switch is activated, or any errors conditions occur (eg: cable unplugged, short circuit, over temperature, water detected etc) the thrusters are immediately deactivated by main control module 1900 and/or control module 1006.
3) Underwater navigation system 2102—a new methodology to bypass accelerometer in a Global Positioning System (GPS) and apply dead-reckoning methodology by using other measuring devices (e.g. flow meters) to provide acceleration readings. This application, if successful, can also be used in land/underground areas where GPS signal is not available at all.
4) Diver Head-Up-Display (HUD) 2104—a projected view of information shown to the user by projecting information through a prism installed on a water-proof diver's helmet. User can flip sideways or up the projector away from normal viewing to reduce glazing from the projector (much like the apache helicopter pilot's HUD).
5) Vector thrust system 2100—a set of gimbal thrusters controlled by several pulse-read motors, creates the vector thrust system through pulse generated from control module. From motion-sensing, whichever the user indicates by the motion, the thrusters will react and move according to the direction indicated by the user motion. This allows the thrusters to perform the "pitch, roll and yaw" vectors in all directions (much like a rocket using its booster adjusting its flight). Together with motion sensing, this application can be applied/transferred for autonomous vehicles, robotics or remote sensing equipment, turret and/or weaponry, etc.
6) User input waypoints 2110—Once all the above functions are achieved, the user input waypoints are indicating the coordinates required to travel to a certain distance and bearing, the vector thrust system will follow the waypoints, while the main control module #1 controls the motor system required for vector thrust and monitor the speed from the flow meter to constantly checking the speed of the thrusters. This allows a fully functioning "Auto-Pilot" control of the JCS, which can be applied for an advanced autonomous vehicles or self navigation capabilities.
7) A cellular telephone module can be installed in the battery canister compartment or handheld waterproof compartment with remote/wired access capabilities. The diver can then speak through a full face mask to connect to the above water telephone network via a surface buoy. Voice commands may be used to call preset numbers, or if the device detects an emergency condition an emergency number might be called with a pre-recorded emergency message.
8) A different type of power switch can be used to detect diver awareness, by means of hand or jaws depression. A diver can press on a spring loaded hand switch or a force sensor installed in the diver regulator's mouth piece, which senses the amount of force the diver's jaws holds the mouth piece. Through these two methods, any sudden reduction in forces will trigger the control module to deactivate the thrusters immediately.

Usage

Once in the water, when the diver is oriented in the desired direction, the on/off switch is actuated to energize the thrusters. The thrusters 212 are then controlled as described above. Any further control(s) (non-critical) can communicate wirelessly between the Hand Controller and the ECM and other devices such as a Head-Up-Display (HUD) in the diver's mask. An acoustic modem with a hydrophone can be installed in the ECM to exchange information with other diver teams in the water. Information received by other divers can in turn be displayed on their mask, allowing networking in the water.

To charge the batteries an electronic controlled charger may be connected to the batteries and ensures all the cells within the battery are charged evenly.

For upgrading, additional software modules the ECM module by connecting any spare ports to a computer. Additionally an ECM module with upgraded firmware may be used to replace the existing ECM module in a plug and play manner. Individual parts of the JCS can be dismantled and replaced or upgraded accordingly by a skilled user.

Whilst exemplary embodiments of the invention have been described in detail, many variations are possible within the scope of the invention as will be clear to a skilled reader.

REFERENCE NUMERALS

200 canister head
202 body adapter
204 hand bar
206 tow converter
208 battery canister
210 ECM module
212 thruster
214 quick release adapter
216 hand controller
218 cables
220 push converter
224 headlight canister
226 waterproof battery pack
300 tow/pull type scooter
302 LCD panel
400 pin lock mechanism
402 on/off switch
403 speed control knob
404 hinge
406 slots
408 latches
500 battery canister top
502 secondary sealing cover
504 O-ring
506 inner wall
508 outer casing
510 battery compartment
512 port plug
520 battery pack
600, 602 individual power switches
604, 606 water-proof push buttons
700 thigh strap configuration
702 waist belt
800 propeller
802 safety barrier
804 female connector
806 slot
808 release button
810 straps
900 outer surface
902 I/O connectors
904 inner surface
906 reset switch
1000 guide
1002 hole
1004 on/off switch
1006 control module
1100 calf strap configuration
1102 hinged mechanism
1200 push configuration
1202 channels
1204 straps
1206 channel
1208 slots
1300 tank mount configuration
1302 tank
1304 double tank system
1501 transparent plastic faceplate
1502 a bulb
1504 front section
1506 PCB,
1508 first seal
1510 second seal
1512 underwater water pluggable connector
1514 battery compartment
1518 waterproof switch
1520 end cover
1522 reduced space gap
1524 small holes
1600 underwater changeable battery canister
1602 end cover
1604 water-proof push-button
1606 female connector
1608 male connector
1610 slot
1900 main control module
1901 voltage regulator
1902 other electronics
1904 motor driver ESC
2000 speed control
2002 mode switching
2004 speed controller
2100 vector thrust system
2102 underwater navigation system
2104 underwater HUD unit
2106 flow meters
2108 water detectors
2110 user input waypoints
2200 latch
2202 spring
2204 hinge
2301 Forward thrust
2302 Right-side thrust
2303 Forward-Right thrust
2304 Left-side thrust
2305 Forward-Left thrust
2306 Backward thrust
2307 Backward-Right thrust
2308 Backward-Left thrust

The invention claimed is:

1. An underwater propulsion device comprising:

at least one propulsion unit removably attached to a tank, a scooter, a saddle, or adapted to be attached to a user;

a controller configured to receive the user's input;

a battery canister removably attached to a scooter, a saddle, or adapted to be attached to a user;

wherein the propulsion unit comprises a thruster and an adapter having an actuator, a latching mechanism, and a longitudinal slot, the thruster being attachable to the adapter by the latching mechanism;

wherein the thruster comprises an engagement portion having a latching gap, wherein the engagement portion is aligned along a main axis of the thruster, and wherein the engagement portion is configured to nest within the longitudinal slot of the adapter;

wherein the latching mechanism comprises:

a first spring mechanism comprising a first spring coupled to a latch, wherein the latch is biased to engage the latching gap of the engagement portion of the thruster when the engagement portion is nested within the longitudinal slot, and a second spring mechanism comprising a second spring, wherein the second spring biases the engagement portion out of the longitudinal slot when the engagement portion is nested within the longitudinal slot, wherein the latching mechanism is configured to eject the engagement portion from the longitudinal slot along the main axis of the longitudinal slot past the latch when the latch is released from the latching gap; and wherein the actuator is connected to the latch such that the actuator is depressable against the biasing force of the first spring to release the latch from the latching gap to thereby eject the thruster from the adapter along the main axis of the longitudinal slot.

2. The underwater propulsion device as claimed in claim 1 wherein the propulsion unit, the controller, and the battery canister are configured to be connected by cables that may be removed and reconnected underwater.

3. The underwater propulsion device as claimed in claim 2 wherein each cable includes a wet connector at each end.

4. The underwater propulsion device as claimed in claim 1 wherein the thruster may include a propeller, turbine, jet, or pump.

5. The underwater propulsion device as claimed in claim 1 wherein the controller includes a motion sensor configured to strap to the user approximately above a radius bone or any parts of the user's body.

6. The underwater propulsion device as claimed in claim 5 wherein the controller is configured to translate movements of the wrist as detected by the motion sensor into a left or right turn and/or speed control signals to the propulsion unit.

7. The underwater propulsion device as claimed in claim 1 wherein the controller includes a speed control switch or a speed control knob to control the speed of the propulsion unit.

8. The underwater propulsion device as claimed in claim 1 wherein the adapter comprises a hinged mechanism rotatably coupling the thruster to the adapter to angle the thruster substantially away from the user's leg.

9. The underwater propulsion device as claimed in claim 1 wherein the battery canister is configured to allow a battery to be removed and to be replaced underwater.

10. The underwater propulsion device as claimed in claim 1 wherein the propulsion unit includes a motor.

11. The underwater propulsion device as claimed in claim 7 further comprising a navigation module configured to vary the left and right and/or speed control signals depending on the output of a flow detector and one or more way points.

12. The underwater propulsion device as claimed in claim 1 further comprising an image projection unit and/or an LCD panel configured to display control information received from the controller.

13. The underwater propulsion device as claimed in claim 6, comprising at least two thrusters attachable to the user, wherein the speed control signals are translated to independent drive signals to the at least two thrusters.

14. The underwater propulsion device as claimed in claim 1, wherein the at least one propulsion unit is removably attached to the user, the tank, the scooter, or the saddle by the adapter.

15. The underwater propulsion device as claimed in claim 14, wherein the adapter is received within a slot of the tank, the scooter or the saddle, or wherein the adapter has a strap threaded therethrough for attachment to the user.

16. The underwater propulsion device as claimed in claim 5, wherein one or more fingers of a hand coupled to the wrist remain free of the motion sensor.

17. The underwater propulsion device as claimed in claim 5, further comprising an on/off switch, wherein the on/off switch is configured to be in an on position when disposed towards the user's body, and wherein the on/off switch is configured to be in an off position when disposed away from the user's body.

18. The underwater propulsion device as claimed in claim 1, wherein the actuator protrudes from an upper surface of the adapter.

19. The underwater propulsion device as claimed in claim 1, further comprising a plurality of cables, wherein the thruster, the controller, and the battery canister are connected by the plurality of cables.

20. The underwater propulsion device as claimed in claim 19, wherein the at least one cable of the plurality of cables remain coupled to the thruster when the engagement portion is not disposed in the longitudinal slot.

* * * * *